US012410679B2

(12) United States Patent
Werries et al.

(10) Patent No.: US 12,410,679 B2
(45) Date of Patent: Sep. 9, 2025

(54) FLUID PRESSURE-ACTIVATED VALVE ASSEMBLY WITH FLOW RESTRICTION AND SYSTEMS AND METHODS FOR IN SITU OPERATIONS

(71) Applicant: NCS MULTISTAGE INC., Calgary (CA)

(72) Inventors: Michael Werries, Calgary (CA); Jesse Powell, Calgary (CA); Ryan Redecopp, Calgary (CA); Juan Montero, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 0 days.

(21) Appl. No.: 18/249,101

(22) PCT Filed: Oct. 13, 2021

(86) PCT No.: PCT/CA2021/051435

§ 371 (c)(1),
(2) Date: Apr. 14, 2023

(87) PCT Pub. No.: WO2022/077104

PCT Pub. Date: Apr. 21, 2022

(65) Prior Publication Data

US 2023/0392473 A1 Dec. 7, 2023

Related U.S. Application Data

(60) Provisional application No. 63/092,656, filed on Oct. 16, 2020.

(51) Int. Cl.
*E21B 34/06* (2006.01)
*E21B 43/16* (2006.01)
(Continued)

(52) U.S. Cl.
CPC ..... *E21B 34/063* (2013.01); *E21B 43/16* (2013.01); *E21B 43/26* (2013.01); *E21B 33/12* (2013.01)

(58) Field of Classification Search
CPC ..... E21B 34/063; E21B 33/12
(Continued)

(56) References Cited

PUBLICATIONS

International Search Report prepared by the Canadian Intellectual Property Office on Dec. 19, 2021, for International Application No. PCT/CA2021/051435, 4 pgs.
(Continued)

*Primary Examiner* — Tara Schimpf
*Assistant Examiner* — Patrick F Lambe
(74) *Attorney, Agent, or Firm* — Sheridan Ross PC

(57) ABSTRACT

A well completion system for producing fluids from a wellbore provided in a subterranean reservoir is provided. The well completion system includes tubing segments connectable to one another along the wellbore. The tubing segments include injection segments provided along the wellbore in spaced-apart relation to each other, each injection segment has an injection valve toollessly operable between a closed configuration preventing fluid flow into the reservoir, and an open configuration allowing fluid flow into the reservoir. The tubing segments also include production segments provided along the wellbore in a staggered relation with respect to the injection segments and configured to allow fluids received from the reservoir to be produced from the reservoir. The tubing segments each are configured to include injection fluid passages and production fluid passages isolated from one another along the wellbore to enable synchronously injecting and producing fluids to and from the reservoir at respective fractured locations.

17 Claims, 21 Drawing Sheets

(51) Int. Cl.
*E21B 43/26* (2006.01)
*E21B 33/12* (2006.01)

(58) Field of Classification Search
USPC ..... 166/308.1
See application file for complete search history.

(56) References Cited

PUBLICATIONS

Written Opinion prepared by the Canadian Intellectual Property Office on Dec. 20, 2021, for International Application No. PCT/CA2021/051435, 4 pgs.

FLUID PRESSURE-ACTIVATED VALVE ASSEMBLY WITH FLOW RESTRICTION AND SYSTEMS AND METHODS FOR IN SITU OPERATIONS

CROSS REFERENCE TO RELATED APPLICATIONS

This application is a national stage application under 35 U.S.C. 371 and claims the benefit of PCT Application No. PCT/CA2021/051435, having an international filing date of 13 Oct. 2021, which designated the United States, which PCT application claimed the benefit of U.S. Provisional Patent Application No. 63/092,656, filed 16 Oct. 2020, the entire disclosures of each of which are incorporated herein by reference.

TECHNICAL FIELD

The present disclosure relates to technologies for subterranean fluid injection operations and, more particularly, to valve assemblies, systems and methods that can be used to inject and produce fluids, such as hydrocarbon material, from subterranean formations.

BACKGROUND

Recovering hydrocarbons from an underground formation can be enhanced by fracturing the formation in order to form fractures through which hydrocarbons can flow from the reservoir into a well. Fracturing can be performed prior to primary recovery where hydrocarbons are produced to the surface without imparting energy into the reservoir. Fracturing can be performed in stages along the well to provide a series of fractured zones in the reservoir. Following primary recovery, it can be of interest to inject fluids to increase reservoir pressure and/or displace hydrocarbons as part of a secondary recovery phase. Tertiary recovery can also be performed to increase the mobility of the hydrocarbons, for example by injecting mobilizing fluid and/or heating the reservoir. Tertiary recovery of oil is often referred to as enhanced oil recovery (EOR). Depending on various factors, primary recovery can be immediately followed by tertiary recovery without conducting any secondary recovery. In addition, some recovery operations include elements of pressurization and displacement as well as mobilizing of the hydrocarbons. Injecting fluids into a fractured reservoir and recovering hydrocarbons involves various challenges and there is a need for enhanced technologies in this field.

SUMMARY

According to a first aspect, a well completion system for producing hydrocarbons from a fractured hydrocarbon-containing reservoir via a wellbore provided in the hydrocarbon-containing reservoir is provided. The well completion system includes a tubing string extending along the wellbore and comprising an injection segment. The injection segment includes an injection valve including an injection valve housing defining an injection fluid passage allowing injection fluid to flow through the housing, and an injection port for establishing fluid communication with the surrounding reservoir to enable injection of injection fluid within the reservoir. The injection valve having a flow restriction component configured to restrict fluid flow between the injection fluid passage and the injection port and a breakable barrier installed within the injection port, the breakable barrier being fluid-activated to operate the injection valve between a closed configuration where the breakable barrier occludes the injection port for preventing fluid flow into the reservoir, and an open configuration where the breakable barrier is removed from within the injection port for allowing fluid flow into the reservoir. The tubing string further comprises a production segment comprising a tubular housing defining a production fluid passage therethrough allowing production fluid to flow through the housing, and having a production port for establishing fluid communication between the production fluid passage and the surrounding reservoir to enable flow of production fluid from the reservoir into the production fluid passage, the tubular housing further including injection fluid passageways allowing injection fluid to flow through the production segment. The tubing string further includes one or more injection conduits coupled to the injection and production segments, and being adapted to allow injection fluid to flow along the wellbore through at least one injection or production segment, each injection conduit being in fluid communication with the injection fluid passage. The tubing string further includes one or more production conduits coupled to the injection and production segments, and being adapted to allow production fluid to flow along the wellbore through at least one injection or production segment, each production conduit being in fluid communication with the production fluid passage. The tubing string further includes a connection segment comprising an injection coupling adapted to connect the injection conduit to one of another injection conduit and the injection valve housing; and a production coupling engaged with the injection coupling and configured to connect the production conduit to one of another production conduit and the tubular housing of the production segment, the production coupling comprising a conduit stabilizer configured to position the production coupling relative to the injection coupling in order to position the production conduit relative to the injection conduit.

According to a possible implementation, the production conduit extends within respective injection conduits and defines an annulus between the production and injection conduits, and wherein the injection fluid flows along the wellbore in the annulus.

According to a possible implementation, the production conduits are concentric relative to the respective injection conduits.

According to a possible implementation, the injection coupling comprises an injection coupling tubular housing defining a fluid passage to allow a flow of injection fluid therethrough, and a connection site at each end of the injection coupling tubular housing for connection with injection conduits, the injection valve housing or a combination thereof.

According to a possible implementation, the production coupling comprises a production coupling tubular housing defining a fluid passage to allow a flow of production fluid therethrough, and a connection site at each end of the production coupling tubular housing for connection with production conduits, the production segment or a combination thereof.

According to a possible implementation, the production coupling tubular housing is concentrically positioned within the injection coupling tubular housing, and wherein the conduit stabilizer comprises protrusions extending from the production coupling tubular housing towards an inner surface of the injection coupling housing.

According to a possible implementation, the protrusions are spaced apart about the production coupling housing, and wherein an opening is defined between each pair of adjacent protrusions.

According to a possible implementation, the protrusions engage an inner surface of the injection coupling housing and define openings between each pair of adjacent protrusions adapted to allow injection fluid to flow therethrough.

According to a possible implementation, the well completion system further includes an isolation segment having a longitudinal conduit adapted to be connected to at least one of the injection valve housing, the production segment housing, one of the injection conduits and one of the production conduits, the isolation segment further comprising an annular sealing element extending radially and outwardly from the longitudinal conduit, each annular sealing element being operable to be in sealing engagement with an inner surface of the wellbore.

According to a possible implementation, the well completion system further includes a casing string installed along the inner surface of the wellbore and defining an outer annulus between the casing string and the tubing string installed within the wellbore, and wherein the annular sealing elements are adapted to extend through the outer annulus to engage an inner surface of the casing string.

According to a possible implementation, the isolation segment is configured for installation between an adjacent pair of injection and production segments to define corresponding injection and production zones of the reservoir on either sides thereof.

According to a possible implementation, the conduits of the tubing string extending between adjacent segments define blank regions in which neither injection nor production is performed.

According to a possible implementation, the injection segment, the production segment and the isolation segment each include a downhole end shaped and sized to be inserted in and connected to an uphole end of the segment positioned downhole thereto along the tubing string.

According to a possible implementation, the breakable barrier is at least partially made of dissolvable material configured to dissolve when in contact with injection fluid.

According to a possible implementation, the injection valve is fluid pressure-activated between the closed and open configurations.

According to a possible implementation, the breakable barrier is configured to prevent fluid flow through the injection port when pressure within the injection fluid passage is below a predetermined pressure threshold, and rupture once the predetermined pressure threshold is reached to allow fluid flow through the injection port.

According to a possible implementation, the pressure threshold is between about 500 psi and 5000 psi.

According to a possible implementation, the injection valve comprises a valve sleeve provided with the restriction component, the valve sleeve being positioned relative to the valve housing such that the restriction component restricts fluid flow between the injection fluid passage and the injection port.

According to a possible implementation, the valve sleeve is securely connected to an inner surface of the valve housing, and wherein the fluid channel is defined between an outer surface of the valve sleeve and the inner surface of the valve housing.

According to a possible implementation, the restriction component comprises a fluid channel having a channel inlet defined in an inner surface of the valve sleeve, and a channel outlet defined in an outer surface of the valve sleeve, the fluid channel allowing fluid flow therethrough and fluidly connecting the injection fluid passage and the injection port.

According to a possible implementation, the fluid channel is shaped and configured to provide a resistance to fluid flow.

According to a possible implementation, the injection valve comprises a single injection port for injecting injection fluid into the reservoir.

According to a possible implementation, the tubular housing of the production segment comprises a plurality of production ports spaced about and extending radially from the production fluid passage.

According to a possible implementation, the production ports are evenly spaced about the production fluid passage.

According to a possible implementation, the injection fluid passageways extend axially through the tubular housing of the production segment between the production ports.

According to a possible implementation, the injection fluid passageways are in fluid communication with the annulus, and wherein the annulus is sealed from the production fluid passage.

According to a possible implementation, two or more segments of the tubing string are adapted to be connected together at surface to form tubing subassemblies, and wherein the tubing subassemblies are adapted to be connected to one another in an end-to-end manner and run downhole.

According to another aspect, a well completion system for producing hydrocarbons from a wellbore provided in a fractured hydrocarbon-containing reservoir is provided. The well completion system includes a plurality of tubing segments connectable to one another in an end-to-end manner along the wellbore, the tubing segments comprising injection segments provided along the wellbore in spaced-apart relation to each other, each injection segment comprising an injection valve toollessly operable between a closed configuration for preventing fluid flow into the reservoir, and an open configuration for allowing fluid flow into the reservoir at respective stages; and production segments provided along the wellbore in a staggered relation with respect to the injection segments and configured to allow production fluid received from the reservoir to be produced from respective fractured locations and recovered at surface. The plurality of tubing segments each being configured to include injection fluid passages and production fluid passages isolated from one another along the wellbore to enable synchronously injecting and producing fluids to and from the reservoir at respective fractured locations.

According to a possible implementation, the tubing segments further comprise un-ported segments configured to transport fluid longitudinally along the wellbore and prevent both injection in the reservoir and production from the reservoir.

According to a possible implementation, the tubing segments further comprise isolation segments provided between a pair of adjacent production and/or injection segments, the isolation segments comprising an annular sealing elements for isolating the adjacent segments from one another.

According to a possible implementation, the injection valve is fluid pressure-activated from the closed configuration to the open configuration.

According to a possible implementation, the injection valve comprises a breakable barrier configured to rupture at a predetermined pressure threshold.

According to a possible implementation, the well completion system further comprises any one of the features disclosed above.

According to another aspect, a method is provided for recovering hydrocarbons via a well provided in a hydrocarbon-containing reservoir using the well completion system as defined above, the method comprising: injecting an injection fluid down the tubing string and through a plurality of the injection segments into the reservoir to cause displacement of hydrocarbons in the reservoir; and producing a production fluid comprising hydrocarbons from the reservoir via a plurality of the production segments.

According to a possible implementation, the steps of injecting fluid and producing fluid are performed synchronously.

According to a possible implementation, the hydrocarbon-containing reservoir is fractured as part of a plug-and-perf operation.

According to another aspect, a method is provided for producing hydrocarbons from a fractured reservoir via the well completion system as defined above, the method comprising: conducting a synchronous frac-to-frac operation comprising synchronously: injecting an injection fluid into the reservoir via the injection segments; and producing production fluid from the reservoir via the production segments.

According to another aspect, a method of completing a wellbore for the recovery of hydrocarbon via a well provided in a fractured hydrocarbon-containing reservoir is provided. The method comprising: running a tubing string into the well to define an annulus between the tubing string and the wellbore, and defining a plurality of zones isolated from one another along the well defined by isolation devices deployed in spaced-apart relation to each other within the annulus; and for multiple zones, installing a corresponding injection segment along the tubing string, the injection segment having a valve, each valve having an injection port and being configured to be fluid pressure-activated from a closed configuration preventing fluid flow into the surrounding reservoir to an open configuration for establishing fluid communication between the tubing string and the surrounding reservoir, each valve having a fluid channel being shaped and configured such that fluid flowrate from the tubing string to the surrounding reservoir is restricted.

According to a possible implementation, the injection port comprises a breakable barrier configured to obstruct fluid flow through the injection port and into the surrounding reservoir, and wherein pressure-activating each valve includes defeating the breakable barrier to operate the valve in the open configuration.

According to a possible implementation, the breakable barrier is fixedly secured within the valve.

According to yet another aspect, a valve assembly for integration within a wellbore string comprising injection and production conduits deployed within a fractured hydrocarbon-containing reservoir is provided. The valve assembly includes an injection valve comprising: an injection valve housing connectable to the injection conduit of the wellbore string, the injection valve housing defining an injection fluid passage allowing injection fluid to flow through the housing; an injection port defined through the injection valve housing and communicating with the surrounding reservoir to enable injection of injection fluid within the reservoir; a flow controller coupled to the injection port and being configured to be fluid pressure-activated from a closed configuration preventing fluid flow into the surrounding reservoir to an open configuration for establishing fluid communication between the tubing string and the surrounding reservoir; and a valve sleeve fixedly secured within the injection valve housing and overlaying the injection port, the valve sleeve having a fluid channel having a channel inlet communicating with the injection fluid passage, and a channel outlet communicating with the injection port, the fluid channel being shaped and configured such that fluid flowrate from the injection fluid passage to the injection port is restricted.

According to another aspect, a well completion system for producing fluids from a reservoir via a wellbore provided in the reservoir is provided. The well completion system includes a tubing string extending along the wellbore and comprising: an injection segment comprising: an injection valve including an injection valve housing defining an injection fluid passage allowing injection fluid to flow through the housing, and an injection port for establishing fluid communication with the surrounding reservoir to enable injection of injection fluid within the reservoir, the injection valve comprising: a flow restriction component configured to restrict fluid flow between the injection fluid passage and the injection port; a breakable barrier installed within the injection port, the breakable barrier being fluid-activated to operate the injection valve between a closed configuration where the breakable barrier occludes the injection port for preventing fluid flow into the reservoir, and an open configuration where the breakable barrier is removed from within the injection port for allowing fluid flow into the reservoir; a production segment comprising: a tubular housing defining a production fluid passage therethrough allowing production fluid to flow through the housing, and having a production port for establishing fluid communication between the production fluid passage and the surrounding reservoir to enable flow of production fluid from the reservoir into the production fluid passage, the tubular housing further including injection fluid passageways allowing injection fluid to flow through the production segment; one or more injection conduits coupled to the injection and production segments, and being adapted to allow injection fluid to flow along the wellbore through at least one injection or production segment, each injection conduit being in fluid communication with the injection fluid passage; one or more production conduits coupled to the injection and production segments, and being adapted to allow production fluid to flow along the wellbore through at least one injection or production segment, each production conduit being in fluid communication with the production fluid passage; and a connection segment comprising: an injection coupling adapted to connect the injection conduit to one of another injection conduit and the injection valve housing; and a production coupling engaged with the injection coupling and configured to connect the production conduit to one of another production conduit and the tubular housing of the production segment, the production coupling comprising a conduit stabilizer configured to position the production coupling relative to the injection coupling in order to position the production conduit relative to the injection conduit.

According to a possible implementation, the reservoir is a hydrocarbon-containing reservoir.

According to a possible implementation, the reservoir is fractured as part of a plug-and-pert operation.

According to a possible implementation, fluids are produced as part of geothermal or acid solution mining operations.

According to another aspect, a valve assembly for integration within a wellbore string is provided. The valve assembly includes an injection valve housing comprising a tubular housing wall defining an injection fluid passage allowing injection fluid to flow through the housing; an injection port defined radially through the tubular housing wall and being in fluid communication with an external environment to the injection valve housing; a fluid pressure breakable barrier blocking the injection port to provide a closed configuration preventing fluid flow through the injection port, and being breakable in response to a fluid pressure exerted from an internal side thereof to provide injection port; and a flow restriction component having an upstream end in fluid communication with the injection fluid passage and a downstream end in fluid communication with the injection port; and wherein the breakable barrier is configured to rupture above a packer setting pressure for packers used in the wellbore, and the flow restriction component is configured to restrict fluid flow through the valve assembly in the open configuration to maintain fluid pressure in the wellbore to enable a subsequent one of the valve assembly in the closed configuration to receive a fluid pressure sufficient to rupture the breakable barrier thereof while using an overall fluid injection flow rate into the wellbore of 5 L/min to 600 L/min.

According to a possible implementation, the flow restriction component comprises an elongated fluid channel.

According to a possible implementation, the elongated fluid channel extends circumferentially around at least part of the valve assembly.

According to a possible implementation, the elongated fluid channel defines a tortuous path.

According to a possible implementation, the elongated fluid channel comprises a boustrophedonic pattern.

According to a possible implementation, the elongated fluid channel is defined by a groove provided in an outer surface of a sleeve and an inner surface of the housing.

According to a possible implementation, the sleeve is fixedly mounted with respect to the housing.

According to a possible implementation, the elongated fluid channel comprises an upstream part in fluid communication with the injection fluid passage and a downstream part in fluid communication with a proximal portion of the injection port.

According to a possible implementation, the downstream part of the elongated fluid channel has a width that is the same as a diameter of the proximal portion of the injection port.

According to a possible implementation, the downstream part of the elongated fluid channel and the injection port are located downhole with respect to the upstream part of the elongated fluid channel.

According to a possible implementation, the elongated fluid channel is configured to provide a pressure drop thereacross between 200 psi and 5000 psi during fluid flow therethrough.

According to a possible implementation, the flow restriction component is configured to restrict fluid flow through the valve assembly in the open configuration to maintain fluid pressure in the wellbore to enable any subsequent one of the valve assembly in the closed configuration to receive the fluid pressure sufficient to rupture the breakable barrier thereof while using the overall fluid injection flow rate into the wellbore of 5 L/min to 400 L/min or of L/min to 200 L/min.

According to another aspect, a method is provided for recovering fluids via a well provided in a subterranean reservoir using the well completion system, the method comprising: injecting an injection fluid down the tubing string and through a plurality of the injection segments into the reservoir to displace fluids from a first region of the reservoir to a second region of the reservoir; and producing a production fluid from the second region of the reservoir via a plurality of the production segments.

According to a possible implementation, the steps of injecting fluid and producing fluid are performed synchronously.

According to a possible implementation, the reservoir is a hydrocarbon-containing reservoir.

According to a possible implementation, the reservoir is fractured as part of a plug-and-pert operation.

According to a possible implementation, fluids are injected into the reservoir as part of a waterflooding operation.

According to a possible implementation, fluids are injected into the reservoir as part of a CO2 flooding operation.

According to a possible implementation, the reservoir is a geothermal reservoir, and wherein fluids are produced as part of geothermal operations.

According to a possible implementation, fluids are injected into and produced from the reservoir as part of acid solution mining operations.

According to a possible implementation, the production conduit extends within respective injection conduits and defines an annulus between the production and injection conduits, and wherein the injection fluid flows along the wellbore in the annulus.

According to a possible implementation, the production conduits are concentric relative to the respective injection conduits.

According to another aspect, a method is provided comprising injecting a fluid into a wellbore having a well completion system comprising plurality of the valve assemblies, at a fluid flowrate between adapted to cause the breakable barriers to break and enable fluid communication between the valve assemblies and a surrounding reservoir.

According to another aspect, there is provided a method for recovering fluids via a well provided in a subterranean reservoir using a well completion system comprising a tubing string having a plurality of tubing segments connectable to one another in an end-to-end manner along the wellbore for enabling injection of fluids into the reservoir and production of fluids from the reservoir at corresponding stages of the well, the method comprising injecting an injection fluid down injection conduits of the tubing string, through a plurality of injection segments and into the reservoir to displace fluids from a first region of the reservoir to a second region of the reservoir; and producing a production fluid from the second region of the reservoir via a plurality of production segments into production conduits concentrically arranged relative to the injection conduits.

DETAILED DESCRIPTION

Figure 1:
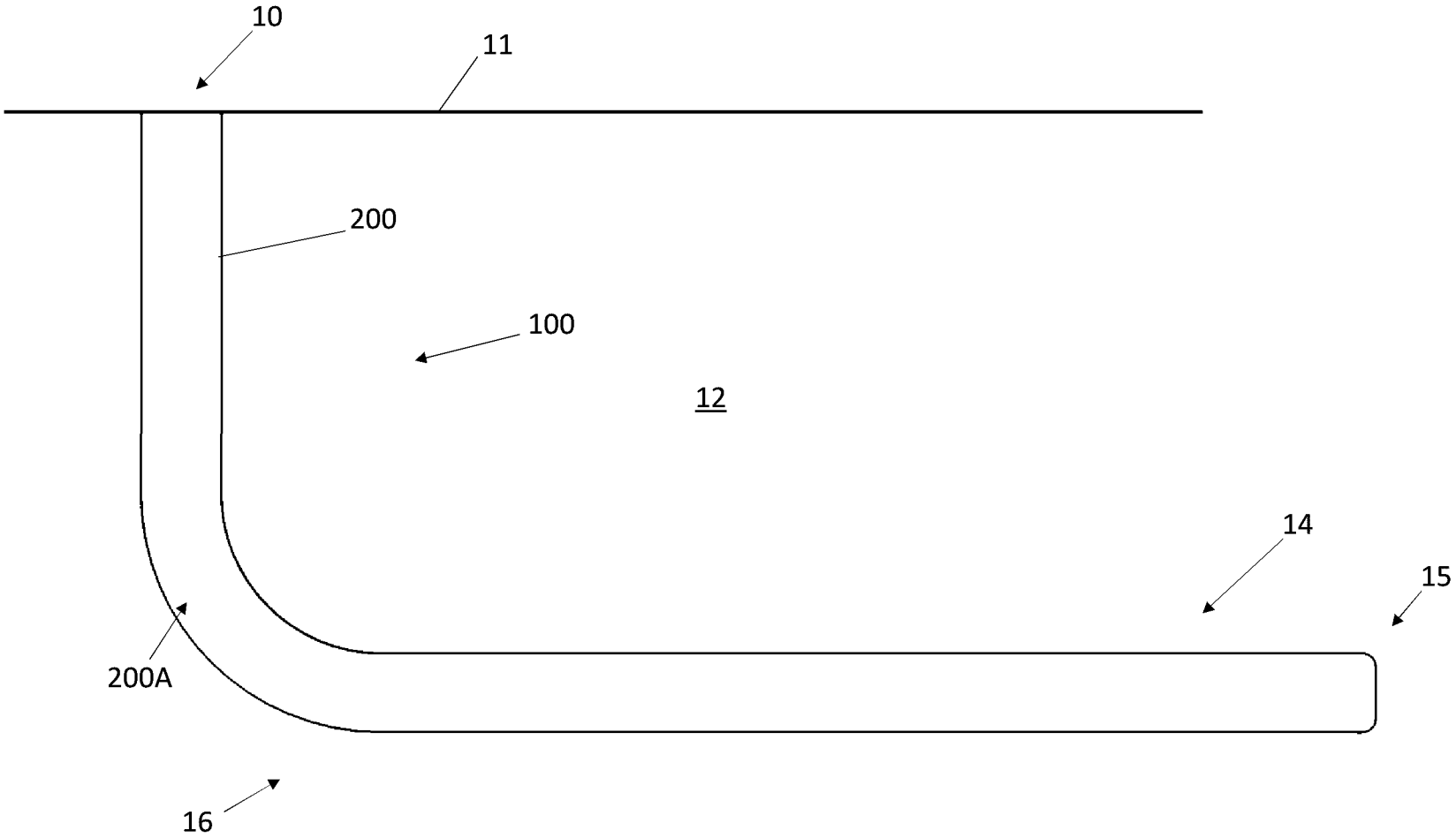
FIG. 1 is a transverse cut view of a wellbore with a horizontal section extending in a reservoir.

As will be explained below in relation to various implementations, the present disclosure describes apparatuses, systems and methods for various operations, such as the recovery of hydrocarbon material from a subterranean formation. The present disclosure describes a fluid pressure-activated valve assembly that is deployed in a well in a closed configuration and is converted to an open configuration using fluid pressure to defeat a barrier blocking a fluid port to enable injection via the valve assembly into the reservoir. The valve assembly can also include a flow restriction, such as a tortuous path, in fluid communication with the port such that fluid injection via the port is restricted once the barrier is defeated. The present disclosure also describes a conduit assembly that can be deployed in the well and includes production and injection conduits as well as other components configured to facilitate simultaneous injection and production, e.g., in a synchronous frac-to-frac operation. The conduit assembly can be used in conjunction with the fluid pressure-activated valve assemblies that are arranged in spaced-apart relation along the well.

The present disclosure relates to a well completion system, and corresponding structural features, operable for the recovery of fluids, such as hydrocarbons, via the wellbore. The well completion system is configured to be installed within the wellbore and includes a tubing string comprising a plurality of tubing segments operable to inject fluid (e.g., a fluid for stimulating hydrocarbon production via a drive process, such as waterflooding, or via a cyclic process, such as "huff and puff") into the subterranean formation, and also to produce reservoir fluids. In other words, the tubing segments can be configured to allow both injection and production operations within the reservoir.

As will be described further below, the tubing segments can include a combination of injection segments, production segments, sealing segments and connection segments that are connected to one another in certain arrangements. The segments of the well completion system can be cooperatively configured to define passageways, conduits or channels allowing flows of injection and production fluids along the well completion system. Moreover, at least one of the injection and production segments can be coupled to a flow control apparatus, such as a valve assembly, which may be fluid pressure activatable. The valve assembly is configured to establish fluid communication between the well completion system and the reservoir. In some implementations, the valve assembly is toollessly operable, i.e., does not require the intervention of downhole tools, such as shifting tools deployed on coiled tubing, to open the valve assembly to enable fluid communication with the surrounding formation. Such a toollessly-operable valve assembly can be fluid pressure activated, as will be described in further detail below.

It is noted that the completion system and the valve assemblies can be implemented in various wellbores, formations, and applications including hydrocarbon recovery and geothermal applications. In some implementations, the wellbore can be straight, curved, or branched, and can have various wellbore sections. A wellbore section should be considered to be an axial length of a wellbore. A wellbore section can be characterized as "vertical" or "horizontal" even though the actual axial orientation can vary from true vertical or true horizontal, or can tend to undulate or corkscrew or otherwise vary. The term "horizontal", when used to describe a wellbore section, refers to a horizontal or highly deviated wellbore section as understood in the art, such as a wellbore section having a longitudinal axis that is between 70 and 110 degrees from vertical. For simplicity, it is noted that most of the conduits, channels, passageways, pipes, tubes and/or other similar components referred to in the present disclosure have a cross-section that is preferably circular or annular, although it should be appreciated that other shapes are also possible.

In some implementations, reservoir fluids are recovered from the reservoir by initially injecting a fluid (which can be referred to as a mobilizing fluid or an injection fluid) within the reservoir via the injection segments of the well completion system. In some applications, the injection fluid is adapted to mobilize hydrocarbons contained in the reservoir and drive the hydrocarbons towards the production segments or a production well for recovery of the hydrocarbons. In hydrocarbon recovery operations, the production segments are adapted for receiving fluid that can include mobilized hydrocarbons from the reservoir and for producing the mobilized hydrocarbons to ultimately recover the hydrocarbons at surface.

Figure 2:
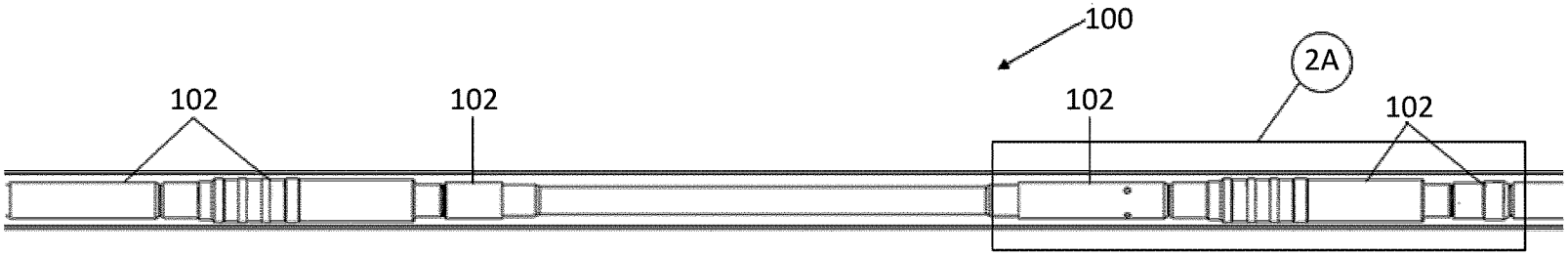
FIG. 2 is a transverse cut view of a section of a well completion system according to an embodiment, showing a plurality of tubing segments connected to one another.
Figure 2A:
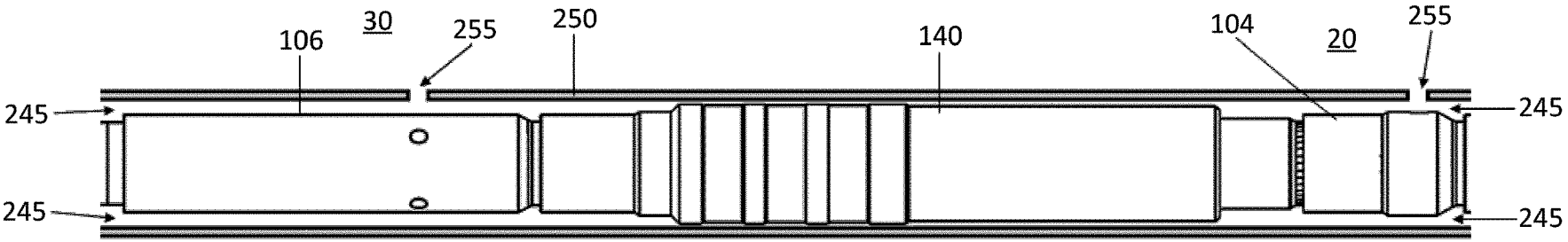
FIG. 2A is an enlarged view of the section identified in FIG. 2, showing the tubing segments installed within a casing string, according to an embodiment.

With reference to FIGS. 1, 2 and 2A, a wellbore 10 extends from the surface 11 and into a reservoir 12. A well completion system 100 including various tubing segments can be integrated as part of a wellbore string 200 extending within the wellbore 10. The wellbore string 200 defines a wellbore string passage 200A for conducting fluid between the surface 11 and the reservoir 12. In some implementations, the tubing segments each include at least one passage allowing fluid flow therethrough. It should therefore be understood that the tubing segments include passages that can form part of the wellbore string passage 200A along at least a portion of the wellbore.

As seen in FIG. 1, the wellbore 10 can include a horizontal wellbore section 14 having a toe 15 and a heel 16 at respective ends thereof. It should be understood that, as used herein, the expression "toe" refers to an end region of the horizontal wellbore section, such as the end region furthest from surface. Similarly, the expression "heel", as used herein, refers to the opposite end region of the horizontal section, i.e., the beginning of the horizontal wellbore section 14, and may include at least part of the curved transition section between the horizontal and vertical sections of the wellbore 10.

Fluid communication between the wellbore string passage 200A and the reservoir 12 is established via the various tubing segments 102 that make up the well completion system 100. More specifically, as shows in FIGS. 2 and 2A, some of the tubing segments 102 can be provided with one or more ports at respective locations along the wellbore providing fluid communication between the wellbore string and the reservoir. In some implementations, the tubing segments 102 can include one or more injection segments 104 in fluid communication with the reservoir 12 for injecting fluid into the reservoir. The tubing segments 102 can further include one or more production segments 106 in fluid communication with the reservoir 12 for producing production fluids (e.g., mobilized hydrocarbons and/or other fluids recovered from the reservoir). The tubing segments 102 can be installed in any suitable configuration along the wellbore. For example, in one implementation, the injection and production segments are installed in alternating fashion along the wellbore with an isolation segment in between, although it is appreciated that other configurations are possible.

Referring more specifically to FIGS. 3, 3A, 4 and 4A, in addition to FIGS. 1, 2 and 2A, an example injection segment 104, or at least a portion thereof, will be described in greater detail. The injection segment 104 can include a valve assembly 110 operable to establish fluid communication between the wellbore string passage 200A and the reservoir 12. The valve assembly 110 includes at least one injection valve 112 having a valve housing 114 with a tubular wall 115 defining a central passage 116 for enabling fluid communication through the housing 114 (e.g., axially through the housing 114). In other words, the central passage 116 can act as an injection fluid passage configured to allow a flow of injection fluid therethrough and along the well completion system 100. As described above, the injection valve 112 can be adapted to be integrated into the wellbore string 200, and, in this respect, the injection fluid passage 116 forms part of the wellbore string passage 200A.

Figure 4:
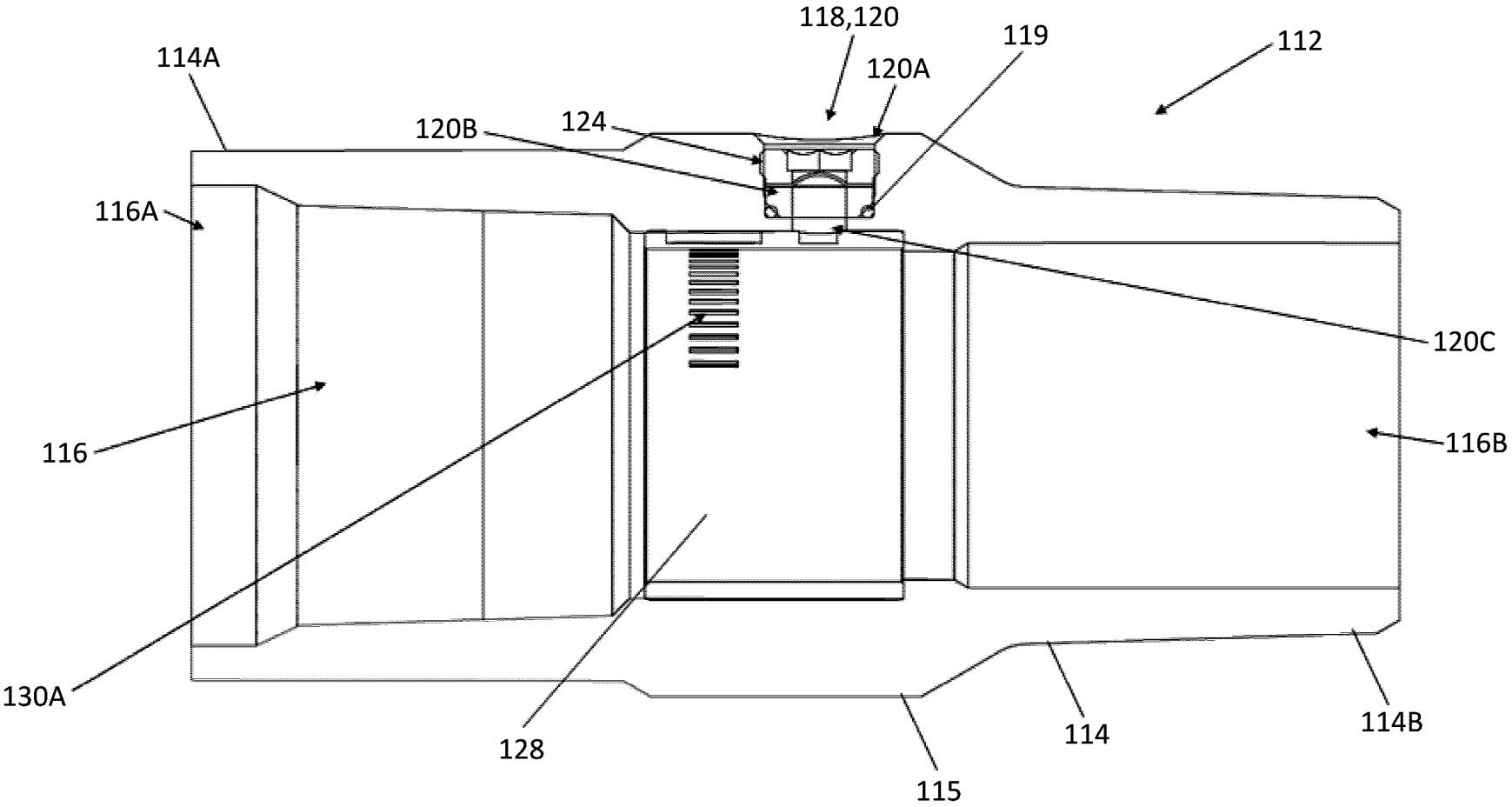
FIG. 4 is a transverse cut view of the injection valve shown in FIG. 3, showing a valve sleeve provided with a fluid channel inlet according to an embodiment.

In this implementation, the valve housing 114 includes a first end, such as an uphole end 114A on a heel-side thereof, and a second end, such as a downhole end 114B on a toe-side, i.e., opposite the uphole end 114A. As illustrated in FIG. 4, the uphole end of the housing 114A defines an injection passage inlet 116A, and the downhole end 114B defines an injection passage outlet 116B. Therefore, in this implementation, it is noted that injection fluid flows into the injection fluid passage 116 via the inlet 116A and exits via the outlet 1168 as the fluid flows towards the toe of the wellbore. However, it is appreciated that other configurations are possible, such as having injection fluid flow towards the heel of the wellbore for injection within the reservoir.

The valve housing 114 also defines a housing outlet 118, through which fluid communication between the passage 116 and an environment external to the housing 114 (e.g., the reservoir 12) is established. In some implementations, for example, the housing outlet 118 includes one or more injection ports 120 defined through the tubular wall 115 of the housing 114. The port 120 can be formed as a generally tubular opening through the valve housing 114. In some implementations, each injection valve 112 is configurable in a plurality of operational configurations, and each one of the operational configurations, independently, corresponds to a state of fluid communication, via the injection ports 120, between the passage 116 and the surrounding reservoir outside of the valve housing 114. In other words, fluid flow through the housing outlet 118 can be at least partially controlled via a change in the operational configuration of the injection valve 112 (e.g., a change from a first operational configuration to a second operational configuration).

In this implementation, the injection valve 112 can be operated in the first operational configuration, such as a closed configuration, where at least one of the injection ports 120 are occluded, therefore preventing fluid flow into the reservoir. In addition, the injection valve 112 can be operated from the closed configuration to the second operational configuration, such as an open configuration, where at least one of the injection ports 120 is at least partially open, or fully open. It is appreciated that in the open configuration, the injection valve 112 enables injection fluid to flow through the one or more injection ports 120 and into the reservoir.

Figure 3:
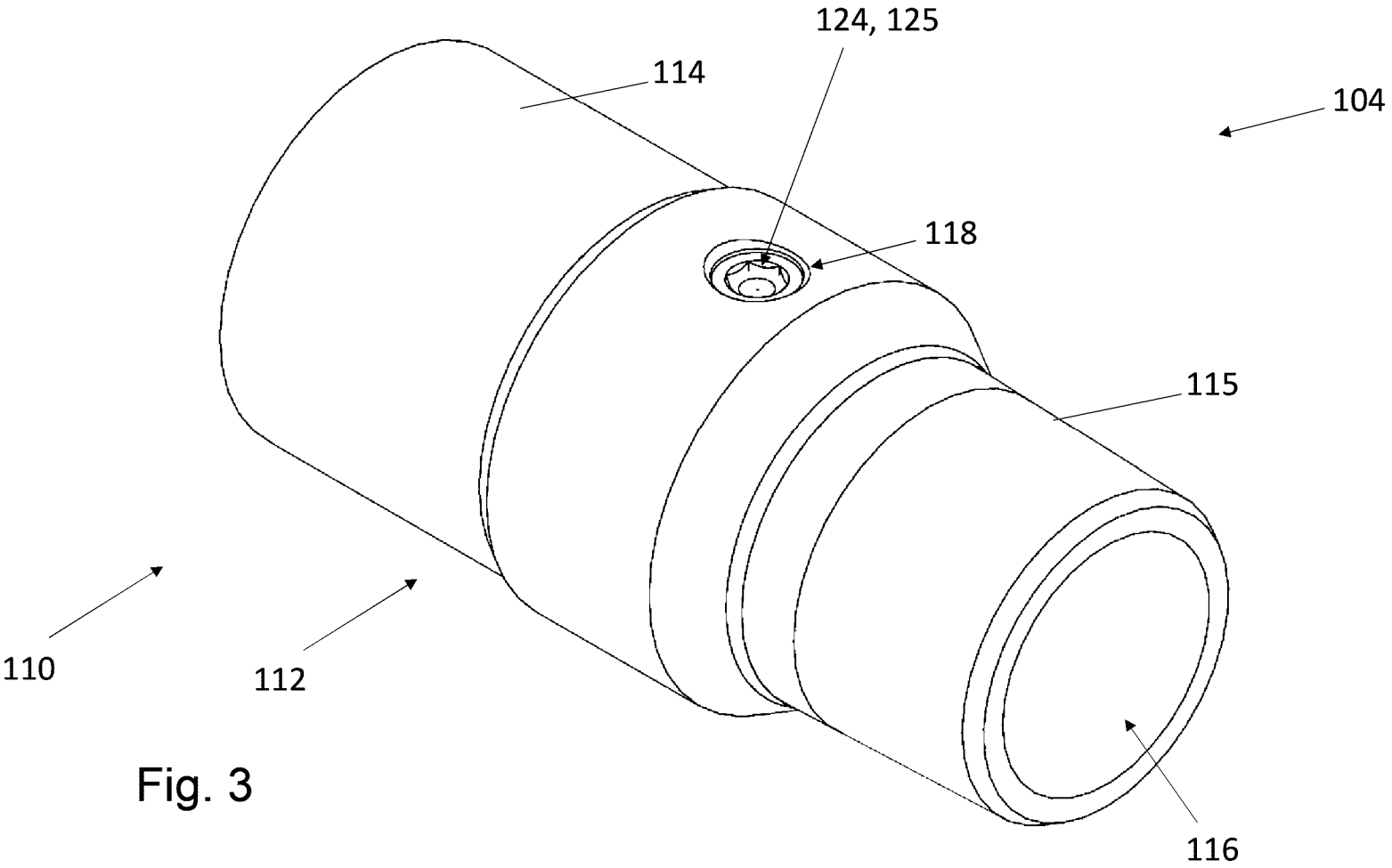
FIG. 3 is a perspective view of an injection valve according to an embodiment, showing an injection port defined through a tubular wall of the valve.
Figure 4A:
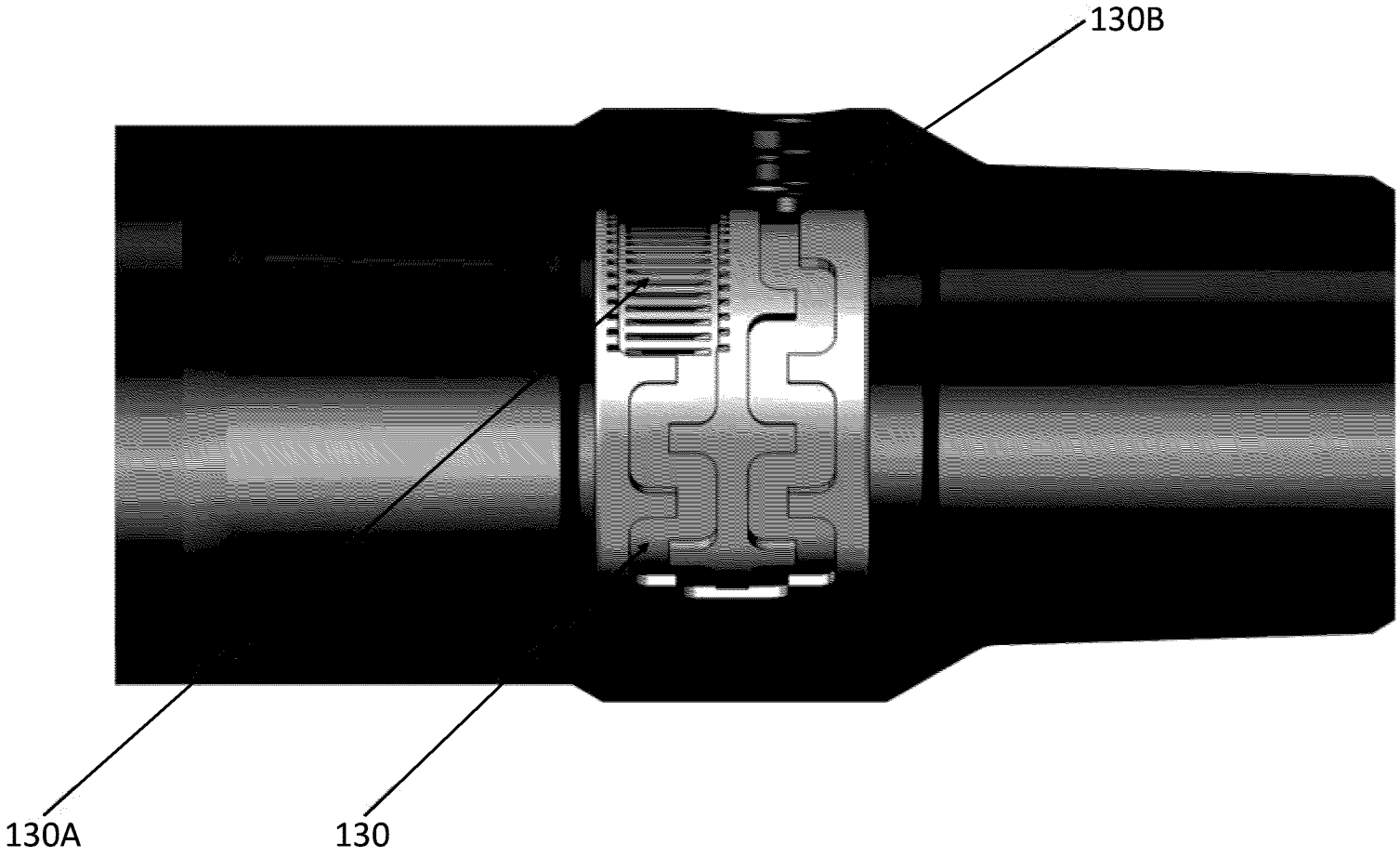
FIG. 4A is a partially cut view of the injection valve shown in FIG. 3, showing a valve sleeve provided with a tortuous fluid channel connecting a fluid passage of the valve and the injection port, according to an embodiment.

Still referring to FIGS. 3 to 4A, in some implementations, the injection valve 112 includes a single injection port 120, and the valve assembly 110 can include a frangible or breakable barrier 124 adapted to occlude the injection port 120, thus preventing fluid communication between the injection fluid passage 116 and the surrounding reservoir 12. The breakable barrier 124 can be configured to maintain the injection port 120 occluded when fluid pressure within the injection fluid passage 116 is below a predetermined pressure threshold, such as below about 5000 psi, below about 3000 psi, or below about 500 psi. The threshold can be defined based on other fluid pressures that may be used in the wellbore, such as a packer setting pressure. It should be appreciated that the valve assembly 110 can include more than one breakable barrier 124, therefore reducing the risk of accidentally injecting fluid into the reservoir. The breakable barriers could thus be arranged in series within the injection port 120.

It is also noted that when the breakable barrier 124 is present, the injection valve 112 is initially in the closed configuration. Once the predetermined pressure threshold is reached, the breakable barrier 124 is defeated and collapses, bursts, or otherwise breaks, thus operating the injection valve in the open configuration. It is appreciated that the breakable barrier 124 can be fully broken or removed from the housing outlet 118 to provide a fully opened port. However, in some implementations, the breakable barrier 124 can be configured to partially collapse in order to have a portion thereof remain within the housing outlet 118 to at least partially obstruct fluid flow between the passage 116 and the reservoir. As such, the injection valve 112 can be toollessly operated from the closed configuration to the open configuration via an increase in the fluid pressure within the valve 112. It is noted that, once a flow of injection fluid is initiated along the wellbore, the injection valve does not require intervention from downhole tools, such as shifting tools deployed on coiled tubing to transition the valve to the open configuration. In other words, the components of the injection valve as described above, other than the rupturing breakable barrier 124, are substantially stationary (e.g., does not include moving or sliding parts) as the valve is fluid pressure-activated from the closed configuration to the open configuration.

In some implementations, the breakable barrier 124 can include a burst disc 125 shaped and configured to cover or occlude the housing outlet 118, although other configurations are possible. For example, one or more plugs can be installed within the injection port 120 and retained therein using shear pins or any other similar and suitable device for retaining the plug in place. The breakable barrier 124 can alternatively include dissolvable components, such as a dissolvable plug, dissolvable retaining pins or rings, or a combination thereof. It is appreciated that the dissolvable components define a time-based mechanism and do not require predetermined pressures (e.g., via pump rates) to actuate the valves. Alternatively, the injection port 120 can be occluded using a piston-activated mechanism, such as a piston configured to be fluid-pressure activated (e.g., using differential pressure) to open the injection port 120. It is appreciated that each injection valve 112 can be provided with the same type and design of breakable barrier 124, or with different types or designs of breakable barriers depending, for example, on the location of the valve 112 along the wellbore. Each port 120 and barrier 124 can be identical for each injection valve 112 provided along the well, or one or more of the ports and/or barrier can be different to provide a different function, such as rupturing at a different fluid pressure, being activated in a different manner, providing a different flow area, and so on.

Figure 3A:
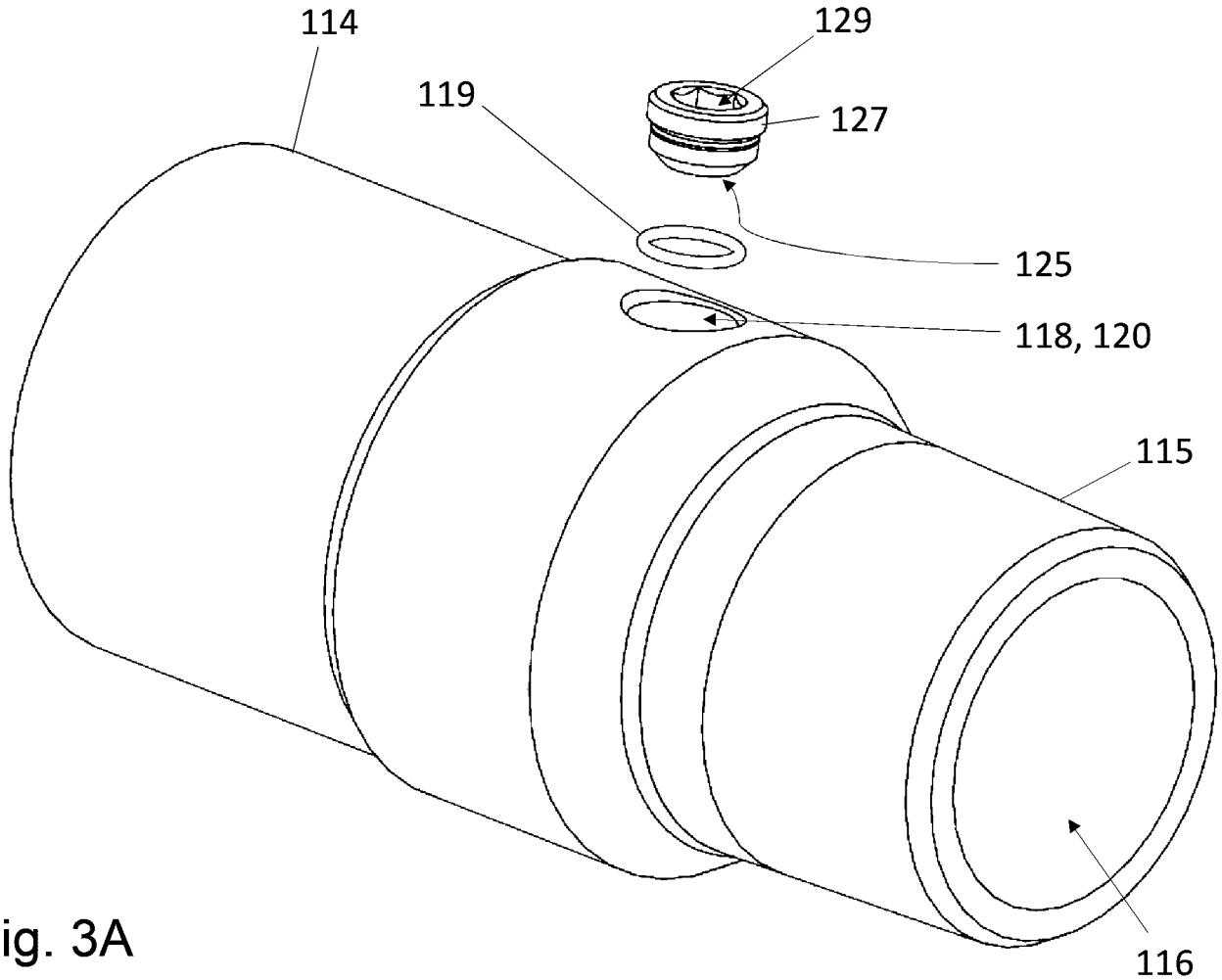
FIG. 3A is a partially exploded view of the valve shown in FIG. 3, showing a breakable barrier configured to be installed within the injection port in accordance with an embodiment.

As seen in FIG. 3A, in this implementation, the breakable barrier 124 includes a barrier body 127 configured to be installed within the injection port 120 and receive thereon the burst disc 125. In some implementations, the burst disc 125 and barrier body 127 can be two separate components configured to cooperate within the injection port 120. Alternatively, the burst disc 125 and barrier body 127 can form a single component configured to be inserted and secured within the injection port 120, and where the burst disc 125 forms a bottom surface of the barrier body 127. It is noted that the barrier body 127 includes a central passage 129 to allow fluid flow therethrough when the burst disc 125 has ruptured. The barrier body 127 can be connected to the valve (i.e., to the housing 114) within the injection port 120 via fasteners, or via any other suitable connection method (e.g., interference fit, cement, threaded connection, etc.).

The breakable barrier 124 can be provided with one or more seals 119 configured to prevent fluid from flowing through the injection port 120 when operating the valve in the closed configuration. In this implementation, the seal 119 includes an O-ring configured to be installed within the injection port 120. However, it is appreciated that other types of seals are possible and may be used, such as welding the barrier 124 within the port, installing the barrier 124 via compression fit, using shim stocks or any other suitable seal or sealing method. It is noted that interstices may be present between the burst disc 125, barrier body 127 and/or an inner surface of the injection port 120. In this implementation, the seal 119 (e.g., the O-ring) is provided on an inner side of the burst disc 125 (i.e., on the side of the fluid passage 116), although it is appreciated that seals can alternatively, or additionally, be provided on an outer side of the barrier 124.

In addition, referring to FIG. 4, the injection port 120 can have a distal portion 120A with tapered edges and being generally frusto-conical; a central portion 120B defined by cylindrical side walls and having a bottom seat that can receive the seal 119 or a bottom part of the breakable barrier, for example; and a proximal portion 120C that is narrower than the central portion and is defined within the housing of the valve. The distal portion 120A can be wider than the central portion 120B which can facilitate insertion of the breakable barrier 124. The proximal portion 120C can have a diameter than is generally the same as the diameter of the central passage 129 of the barrier body 127 (seen in FIG. 3A), for example. The proximal portion 120C is also configured to provide fluid communication with the flow restriction component of the valve. Thus, in some implementations, the port 120 has a configuration where the distal, central and proximal portions are aligned along a same central axis that extends radially through the wall of the valve housing. It is also noted that the port 120 can have various other shapes and configurations.

Referring still to FIGS. 4 and 4A, the injection valve 112 can further comprise a flow restriction component 126 provided in between the port 120 and the injection fluid passage 116 to restrict the flowrate from the passage 116 through the port 120 when the valve is in the open configuration. The flow restriction component 126 can take various forms. For example, the injection valve 112 can include a valve sleeve 128 with a restricted passage configured to control the flowrate of injection fluid being injected into the surrounding reservoir. In this implementation, the valve sleeve 128 is provided with a fluid channel 130 allowing fluid flow therethrough, and thus fluidly connecting the injection fluid passage 116 and the housing outlet 118. The fluid channel 130 can be shaped and configured to provide a resistance to fluid flow, therefore providing additional control on the flowrate of fluid being injected into the surrounding reservoir. For example, the fluid channel 130 can be elongated and configured such that the open configuration of the valve 112 corresponds to a choked configuration, where the fluid flowrate from the injection fluid passage 116 into the reservoir is restricted. The fluid channel 130 can take the form of a tortuous path that winds boustrophedonically across a portion of the valve sleeve 128. The tortuous path can have various other configurations.

Furthermore, in this implementation, the fluid channel 130 can be defined between an outer surface of the valve sleeve 128 and an inner surface of the valve housing 114 overlaying the valve sleeve 128. It should also be noted that, in this implementation, the valve sleeve 128 is securely connected within the valve housing 114 (e.g., via press-fitting) such that the fluid channel 130 remains aligned with the housing outlet 118 before, during and after injection fluid has effectively been injected into the reservoir. However, it is appreciated that other configurations are possible and may be used, such as slidably connecting the valve sleeve 128 within the housing 114 such that the valve sleeve can be shifted between two or more positions for selectively aligning the fluid channel 130 with the housing outlet 118 (e.g., the proximal portion 120C of the port 120).

In the present implementation, referring to FIGS. 4 and 4A, the fluid channel 130 includes a channel inlet section 130A defined in the inner surface of the valve sleeve 128, and a channel outlet section 130B defined in the outer surface of the valve sleeve 128. The channel outlet section 130B being in fluid communication with the housing outlet 118 to enable fluid flow from the fluid passage 116, through the channel 130, and to the housing outlet 118. The channel outlet section 130B can have a channel width that is generally the same as or smaller than the diameter of the proximal portion 120C of the port 120. The port 120 can thus be designed to extend radially through the valve housing, while the flow restriction component takes the form of an elongated channel that extends circumferentially around an inner part of the valve via the sleeve, thereby providing fluid communication between the external environment and the central passage 116 of the valve.

In some implementations, the port 120 and the breakable barrier 124 can also be configured to provide little to no flow restriction to injection fluids, while the flow restriction component (e.g., elongated fluid channel having a tortuous path) provides flow restriction through that valve. This arrangement can facilitate fluid pressure activation of the valves at reasonable flowrates in a well completion system 100 with multiple injection valve assemblies arranged along its length. Once a first breakable barrier is ruptured due to fluid pressures, the port 120 can allow full flow of the injection fluid into the reservoir at that open valve which could hamper fluid activation of the other valve assemblies. However, the flow restriction component controls the fluid injection rate through the open valve assembly and thereby enables the injection fluid pressure to be maintained at sufficient levels to rupture the breakable barriers of the other valve assemblies at reasonable flowrates. The flow resistance therefore prevents over-injection of the fluid via the early activated valve assemblies and enables pressure to be maintained along the wellbore. The flow restriction component can thus be designed to provide the desired flow restriction during the initial valve opening phase of the process to enable flowrates to be kept within a certain range.

In addition, since the flow restriction component can cause a pressure drop, e.g., across the length of the tortuous path, this pressure drop can be taken into account when designing the system and when providing the fluid pressure, e.g., using pumps at surface. For example, the fluid channel 130 can be designed and tested in order to determine the flowrate restriction and the pressure drop across the channel at different potential conditions such as fluid types, flow rates, temperatures, pump types, pressure drops in upstream conduits, and the like. Thus, the adequate fluid pressure and flow rates can be delivered in order break the barrier 124 of each of the desired injection valves. It should be noted that providing the adequate fluid pressure can be further based on various characteristics of the reservoir, such as the reservoir pressure and the reservoir permeability. For example, the lower the reservoir pressure, the higher the flowrate will be through the injection ports for the same restriction.

In addition, it is possible to provide a well completion system where some injection valve assemblies are different from others in terms of the flow restriction and pressure at which the barrier breaks. For instance, one or more injection valves near the toe of the wellbore may have a lower breakage pressure compared to one or more valves as the heel, to account for pressure drop effects along the wellbore. This could be done by providing different burst discs for different valves. In another example, one or more injection valves near the toe could have flow restriction components that provide lower flow restriction (e.g., via shorter or less tortuous paths) compared to those closer to the heel. It is also possible to provide injection valves with particular flow restriction and fluid breakage pressures at particular locations along the wellbore as per the well operator's specifications to account for certain geological or well characteristics (e.g., thief zone, water-bearing zone, natural fracture(s)).

While various valve designs are possible, an example design determination for typical wells is provided below for illustration purposes. In an example implementation, which was assessed using calculations for example well conditions, the total target well injection rate is between 100 and 1000 barrels per day (11 to 110 L/min) across an unknown number of stages within the wellbore. The pressure differential of the fluid flowing across the flow restriction component is taken to be approximately 1000 psi. Various designs of flow restriction components, such as elongated channel and orifices, follow a relationship of flowrate that is proportional to the square root of pressure drop. In some scenarios, the injection valves are designed to open at a fluid pressure that is higher than a typical packer setting pressure, which can be set between about 1500 psi and about 2500 psi, although other setting pressures are possible. One can use a target of 3000 psi at the rupture pressure for this determination, although lower or higher is possible. The square root of 3000/1000 is 1.73, so one can expect each injection valve (if identical to one another) to provide 73% more flow at 3000 psi than 1000 psi. The final total wellbore activation flow rate above would then be 19-190 L/min, a notably reasonable flow rate for 2⅜ inch tubing. One can expect minimal friction at these rates, and flow rate calculations for a 2000 m vertical well with a further 2000 m lateral or horizontal section, with 10 stages spread across, one can confirm roughly 1-2 MPa of friction pressure at activation rates, using an absolute pipe roughness of 0.0002 inch.

The calculations can be done for each valve, and then applied to a well provided with a known number of valves to determine activation pressures. For example, a representative range of flowrates for a single injection valve can be between 2 L/min to 40 L/min. A representative well can include ten (10) injection valves dispersed along the tubing string, thus providing an overall injection rate between about 20 L/min and 400 L/min. Taking the 1.73 ratio calculated above, a range of representative activation flowrates can be determined, such as 3.5 to 69 L/min for a single valve, or 35 to 690 L/min for a representative well.

In addition, one can expand this even further to a target wellbore injection rate of 5000 bbl/day, where one can expect a wellbore injection rate of approximately 550 L/min, and an activation flow rate of 951 L/min (i.e., 73% greater than 550 L/min). It should be noted that the activation flow rate can represent the rate required to open each valve, e.g., to burst the discs of each injection valve. At these rates, considering friction can be more important to provide greater accuracy. For the same 2000 m vertical and 2000 m horizontal well, one can expect a surface injection pressure of 47 MPa for 2⅜ inch tubing to achieve 21 MPa at the toe, which is achievable albeit relatively high. For the same 2000 m vertical and 2000 m horizontal well, one can expect a surface injection pressure of 30 MPa for 2⅞ inch tubing to achieve 21 MPa at the toe, which is achievable and reasonable. It should also be noted that the flowrates calculated herein are for a given size of conduits, and that the flowrates inherently change for different sizes of conduits (e.g., 2⅜", 2⅞", 3½", 4½", 7", 9⅝", etc.).

Reductions in the required activation pressures could be used to notably reduce the required surface pressure, by requiring both less static pressure and reducing the friction pressures via reduced required total flow rates.

Generally, during opening of the valves (e.g., when bursting the discs), depending on the number and size of the valves installed along the wellbore, the flow rate can fluctuate as each valve opens. For example, when the first valve opens, a portion of the fluid being pumped down the wellbore can flow into the reservoir through the open port, thus slightly reducing the flow rate along the wellbore. Therefore, during operation of the wellbore, the surface pressure can be initially substantially low in order to charge the wellbore up, i.e., fill it with fluid. As the first burst disc bursts, the injection rate decreases to a pseudo-steady-state governed by the surface pressure compared to the pressure required to maintain the wellbore at the activation pressure.

If the surface pressure of the pseudo-steady-state is greater than the pressure required to maintain the activation pressure, the valves will open one after the other until the injection rate decreases and the pressure drops below the activation pressure, thereby causing the surface injection pressure to also drop. However, if the surface pressure of the pseudo-steady-state is lower than the pressure required to maintain the activation pressure, a single valve will open and the surface injection pressure will drop.

At this point, the surface pressure can be slightly increased by a predetermined amount to allow one more valve to open. Once the valve opens, another pseudo-steady-state is achieved, although at a higher flow rate. This process can be repeated until all valves have been activated. In some implementations, the pump for the application is appropriately sized and flow-rate steps can be counted to show all valves have been activated.

In some implementations, different burst discs 125 and/or different types of breakable barriers 124 can be installed for each injection valve 112. For example, valves installed further downhole (e.g., closer to the toe of the wellbore) can be provided with burst discs configured to break at lower pressures than burst discs of valves 112 installed proximate the heel of the wellbore. As such, surface injection pressures can be maintained at reasonable levels, since the pressure required to open the valves proximate the toe of the wellbore is not required to be the same as the pressure required to open the valves proximate the heel.

In addition, the flow restriction component can have a different configuration for each or some of the injection valves 112 along the wellbore. For example, the valves proximate the heel can be provided with a flow restriction component configured to cause a predetermined pressure drop, whereas the valves further downhole can have flow restriction components configured to cause a lower pressure drop (e.g., with a shorter channel or a larger orifice), and where the valves furthest downhole can be provided with an even lower pressure drop or possibly a straight opening extending between the wellbore passage and the reservoir. It is also appreciated that a nozzle, such as a carbide nozzle, can be installed within one or more of the injection ports 120 to create a pressure drop, which may be in addition to or as an alternative to the flow restriction component. Moreover, it is noted that a single injection valve 112 can be provided with two or more injection ports 120 with respective breakable barriers 124, therefore increasing the injection rate into the reservoir of that valve. In a multi-port injection valve, there may be a distinct flow restriction component for each port or a flow restriction component that feeds into multiple ports.

Figure 4B:
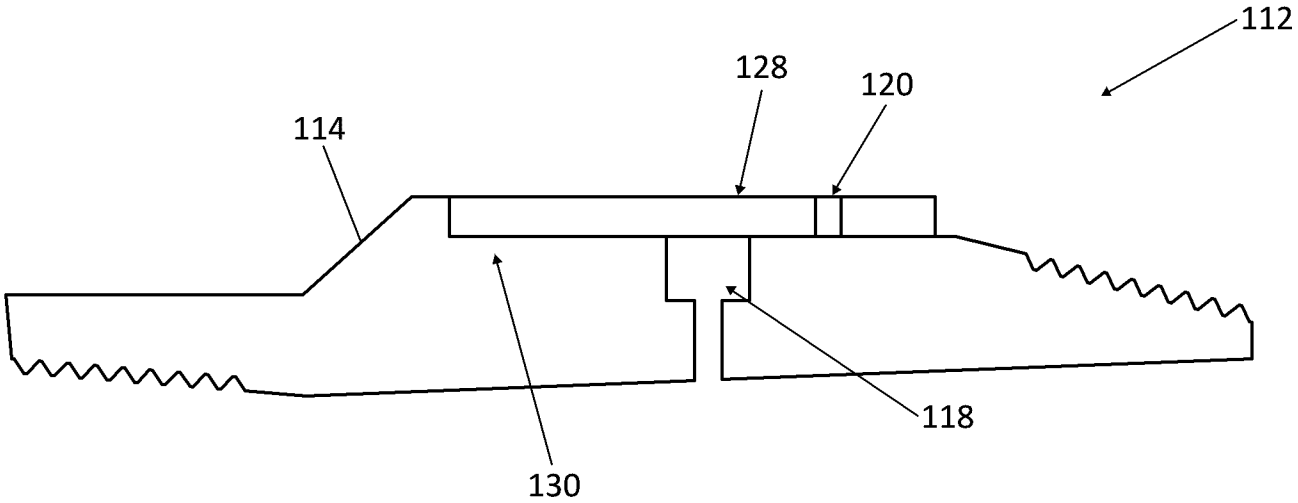
FIG. 4B is a partially cut view of another implementation of the injection valve, showing a valve sleeve provided around the valve housing.

It is noted that alternative implementations of the injection valve 112 are possible. For example, and with reference to FIG. 4B, the valve sleeve 128 can be installed and secured around the valve housing 114. In this implementation, the fluid channel 130 can be defined by a groove provided in an outer surface of the valve housing and the inner surface of the sleeve covering the groove. Alternatively, the groove can be defined in the inner surface of the valve sleeve, with the outer surface of the valve housing covering the groove. The valve sleeve 128 can be provided with the injection port 120 such that injection fluid flows through the housing outlet 118, along the fluid channel 130 (along the outside of the valve housing) and into the reservoir via the injection port 120. The breakable barrier 124 can be installed within the housing outlet 118, within the injection port 120, or both.

Figure 5:
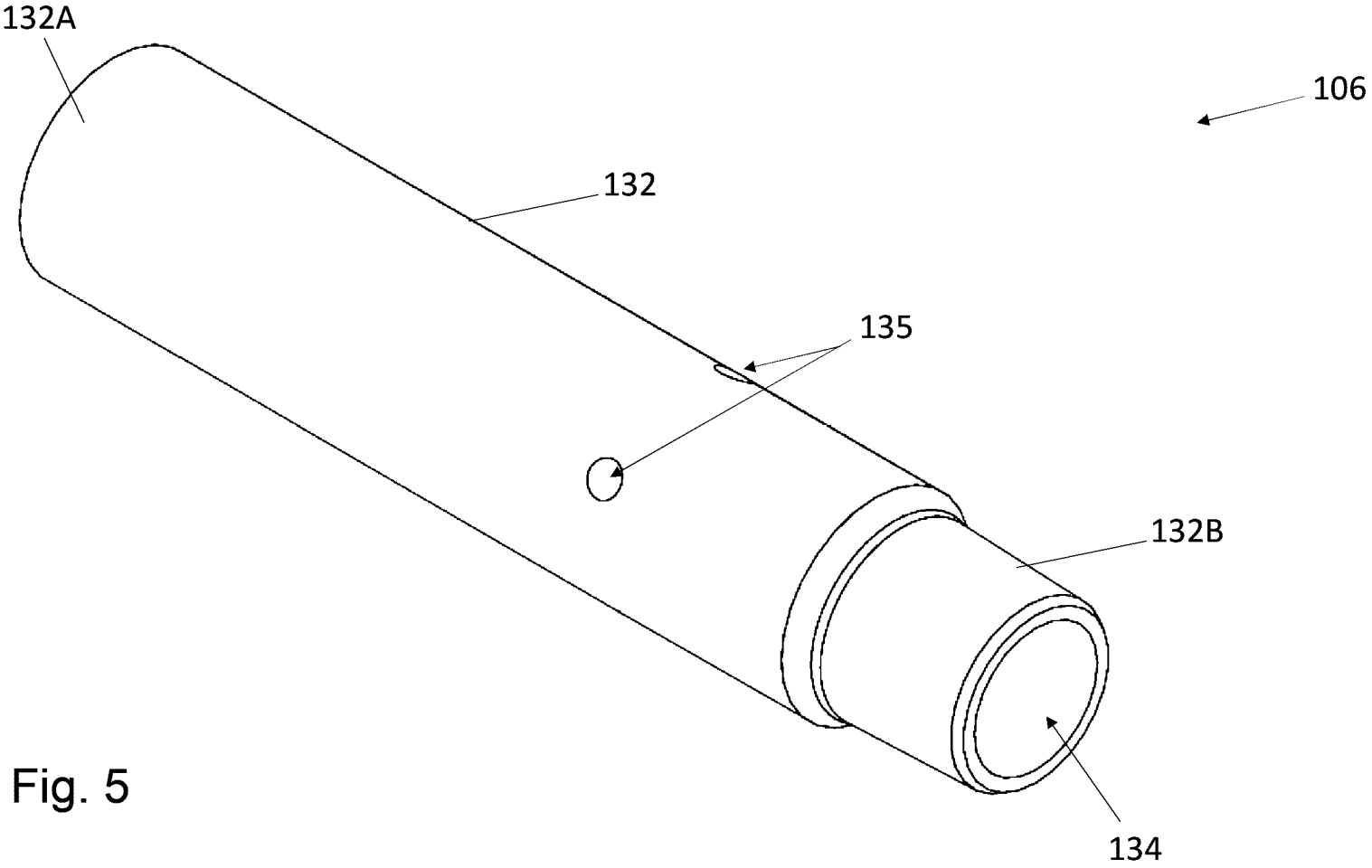
FIG. 5 is a perspective view of a production segment according to an embodiment.
Figure 6:
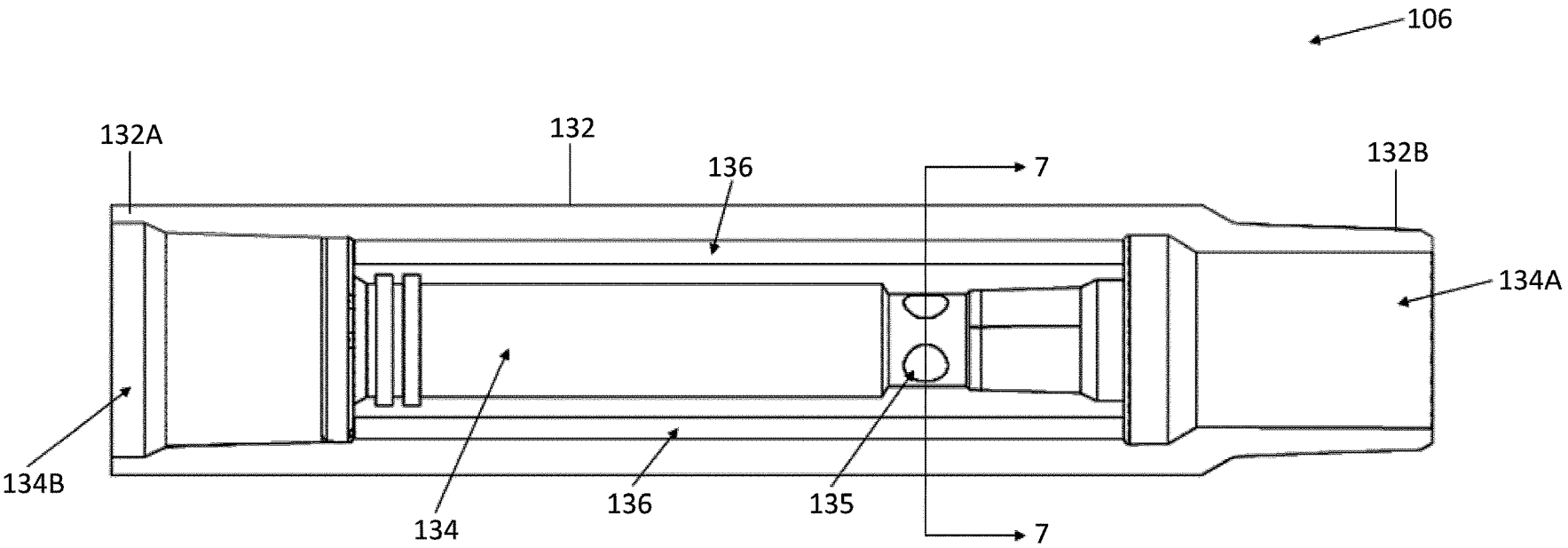
FIG. 6 is a transverse cut view of the production segment shown in FIG. 5, showing various fluids extending through the segment, according to an embodiment.
Figure 7:
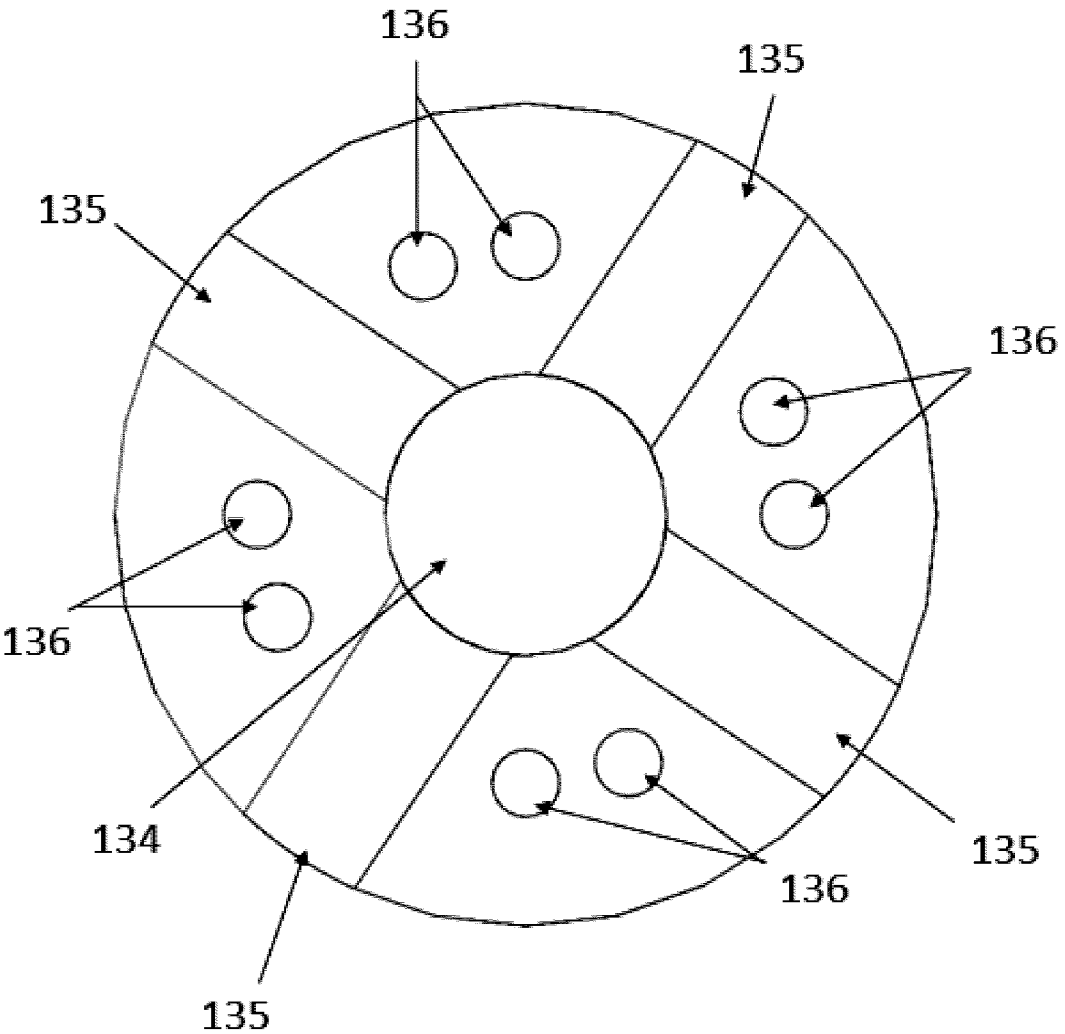
FIG. 7 is a cross-sectional view of the production segment taken along line 7-7 shown in FIG. 6, showing production ports extending radially from a production fluid passage, according to an embodiment.

Now referring to FIGS. 5 to 7, a production segment 106 according to an implementation is shown. The production segment 106 is configured for producing fluids from the reservoir and into the tubing string passage 200A for recovery at surface. In this implementation, the production segment 106 includes a tubular housing 132 defining a production fluid passage 134 therethrough for enabling flow of production fluid. As described above, the production segment 106 can be adapted to be integrated in the wellbore string 200. In this respect, the production fluid passage 134 effectively forms part of the wellbore string passage 200A.

In this implementation, the tubular housing 132 includes a first end, such as an uphole end 132A on a heel-side thereof, and a second end, such as a downhole end 132B on a toe-side, i.e., opposite the uphole end 132A. As illustrated in FIG. 6, the downhole end 132B of the housing 132 defines a production passage inlet 134A, and the uphole end 132A defines a production passage outlet 134B. Therefore, in this implementation, it is noted that production fluid flows into the production fluid passage 134 via the inlet 134A and exits via the outlet 134B as the fluid flows towards the heel of the wellbore. However, it is appreciated that other configurations are possible.

In this implementation, the tubular housing 132 can be provided with at least one outlet through which fluid communication between the passage 134 and an environment external to the tubular housing 132 (e.g., the reservoir 12) is established. In some implementations, the outlet of the production segment 106 includes one or more production ports 135 defined through the tubular housing 132 for establishing fluid communication between the production fluid passage 134 and the reservoir. In this implementation, the production segment includes four (4) production ports 135 extending around the passage 134 at generally regular intervals. For example, and as seen in FIG. 7, the production ports 135 can be spaced from each adjacent production port by about 90 degrees. However, it is appreciated that any other suitable number of production ports can be used, and that the production ports 135 can be dispersed about the production passage 134 in any suitable configuration. The production ports 135 can each be formed as a tubular port having a constant cross-section along its length and extending from a port inlet defined in the wall of the passage 134 to a port outlet defined in the outer surface of the housing. The production ports 135 can be provided circumferentially at a same axial location of the tubular housing 132 and radially spaced apart from each other, for example.

As seen in FIGS. 6 and 7, the production segment 106 can include one or more injection fluid passageways 136 adapted to allow injection fluid to flow through the production segment 106, generally in a toe direction (i.e., in a direction opposite the flow of production fluid along the production fluid passage 134). In this implementation, the production segment includes a plurality of injection fluid passageways 136 distributed in groups (e.g., in pairs) around the production fluid passage 134, although other configurations are possible, such as having the injection fluid passageways 136 distributed generally evenly around the production fluid passage 134. The groups of injection fluid passageways 136 are illustratively spaced from one another to allow the production ports 135 to extend therebetween so as to establish fluid communication from the reservoir to the production fluid passage 134. Likewise, the radial spacing of the production ports 135 can be provided to allow the injection passageways to pass in between adjacent production ports. It is appreciated that the injection fluid passageways 136 and production fluid passage 134 are not in fluid communication with each other such that both injection and production fluids can flow through the production segment 106 simultaneously, for instance to enable synchronous frac-to-frac operations. It should also be noted that the injection fluid passageways 136 can have any suitable shape, size, number and/or configuration extending through the production segment 106.

Although not illustrated, in some implementations, the production segment 106 can be provided with a restriction component, such as the fluid channel 130 described above in relation with the injection valve. The restriction component can be configured to restrict the flowrate of fluids flowing into the fluid passage via the production ports. In some implementations, the production ports can be provided with respective breakable barriers, such as burst discs, and/or be fluidly connected to the fluid passage by a tortuous flow path. These burst discs can be fluid-pressure activated (i.e., broken using fluid pressure) from within the housing 132 by initially injecting fluids within the production segments. Once the ports are open, injection is stopped, and production operations can be initiated. Alternatively, the production segments can be installed downhole without any barrier within the production ports such that the restriction component only includes the elongated and tortuous flowpath.

Providing restriction components to the production segments can be useful if there is a short circuit from the injection stage to the producing stage whereby restricting the production flowrate can assist in mitigating the flow of fluids along the short-circuit flowpath. Short-circuits along the wellbore can be detected using any suitable method or device, such as measuring the pressure along the segments of the wellbore string in order to detect the presence of a short-circuit.

Referring back to FIGS. 1 to 2A, in some implementations, the wellbore 10 includes a casing 250 lining an inner surface of the wellbore 10. The casing 250 can be adapted to contribute to the stabilization of the reservoir 12 after the wellbore 10 has been drilled, e.g., by contributing to the prevention of the collapse of the walls of the wellbore 10. In some implementations, the casing 250 includes one or more successively deployed concentric casing strings, each one of which is positioned within the wellbore 10. In some implementations, each casing string includes a plurality of jointed segments of pipe. The jointed segments of pipe typically have threaded connections although other configurations are possible and may be used.

It can be desirable to seal an annulus formed within the wellbore between the casing string 250 and the reservoir 12. Sealing of the annulus can be desirable for preventing injection fluid from flowing into remote zones of the reservoir, thereby providing greater assurance that the injected fluid is directed to the intended zones of the reservoir. To prevent, or at least interfere with injecting fluid into an unintended zone of the reservoir, or to the surface, the annulus can be filled with an isolation material, such as cement, thereby cementing the casing to the reservoir 12. It should be noted that the cement can also provide one or more of the following functions: (a) strengthens and reinforces the structural integrity of the wellbore, (b) prevents, or substantially prevents, produced fluids of one zone from being diluted by water from other zones. (c) mitigates corrosion of the casing 250, and (d) at least contributes to the support of the casing 250.

It is further noted that, the casing 250 includes a plurality of casing outlets 255 for allowing fluid flow from the wellbore string 200 into and from the reservoir (e.g., via injection and production segments respectively). In some implementations, in order to facilitate fluid communication between the wellbore string 200 and the reservoir 12, each one of the casing outlets 255 can be substantially aligned with a corresponding one of the injection or production segments 104, 106. In this respect, in implementations where the wellbore 10 includes the casing 250, injection fluid is injected from the surface down the wellbore string 200 and through the various segments in order to reach the injection segments 104. Injection fluid then flows through the injection ports 120 of the corresponding valves and into an annular space 245 (seen FIG. 2A) defined between certain portions of the wellbore string 200 and the casing string 250, and finally into the reservoir 12 via the casing outlets 255.

Figure 8:
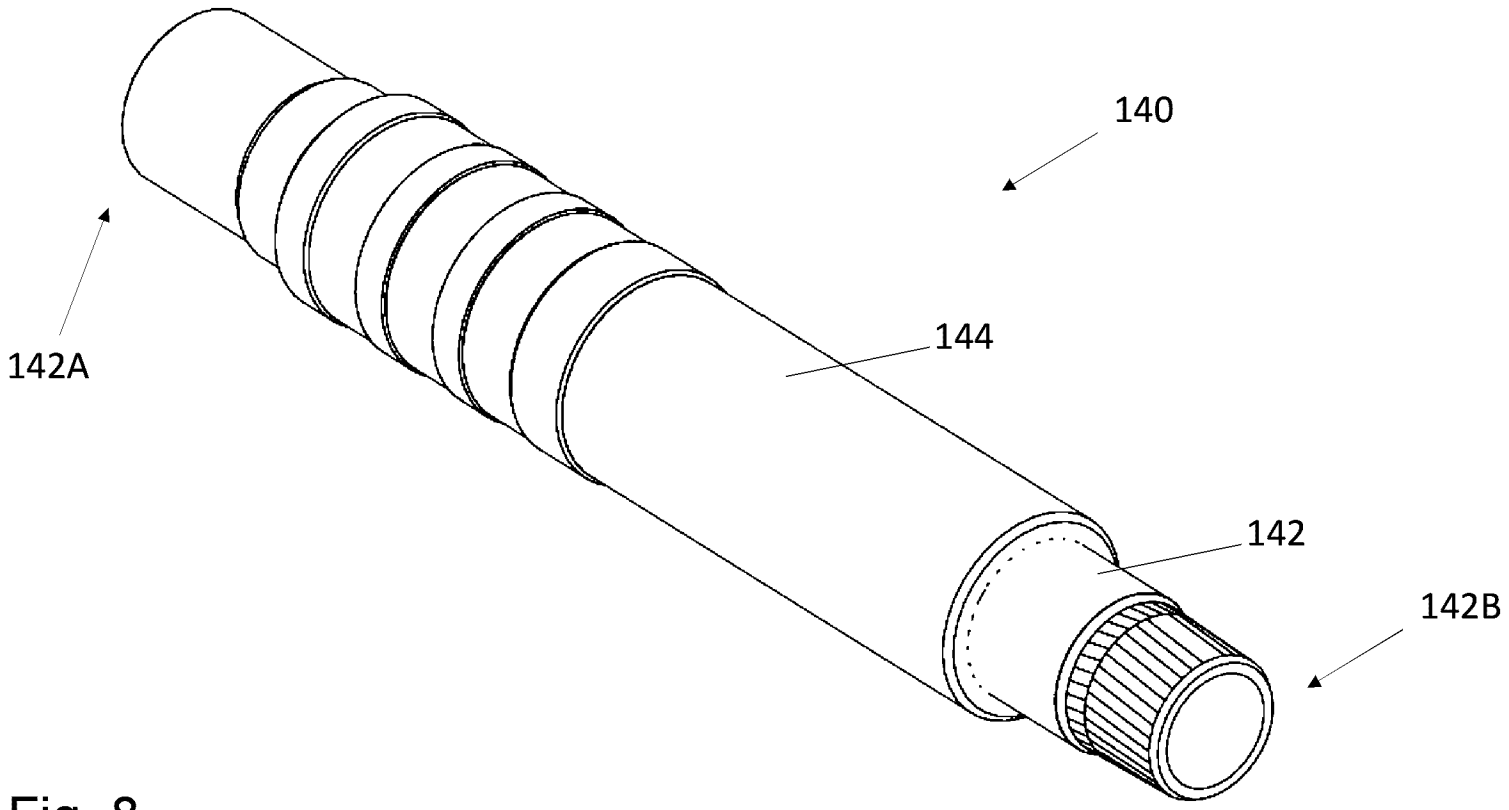
FIG. 8 is a perspective view of an isolation segment according to an embodiment, showing a sealing element provided about an isolation segment housing, according to an embodiment.
Figure 9:
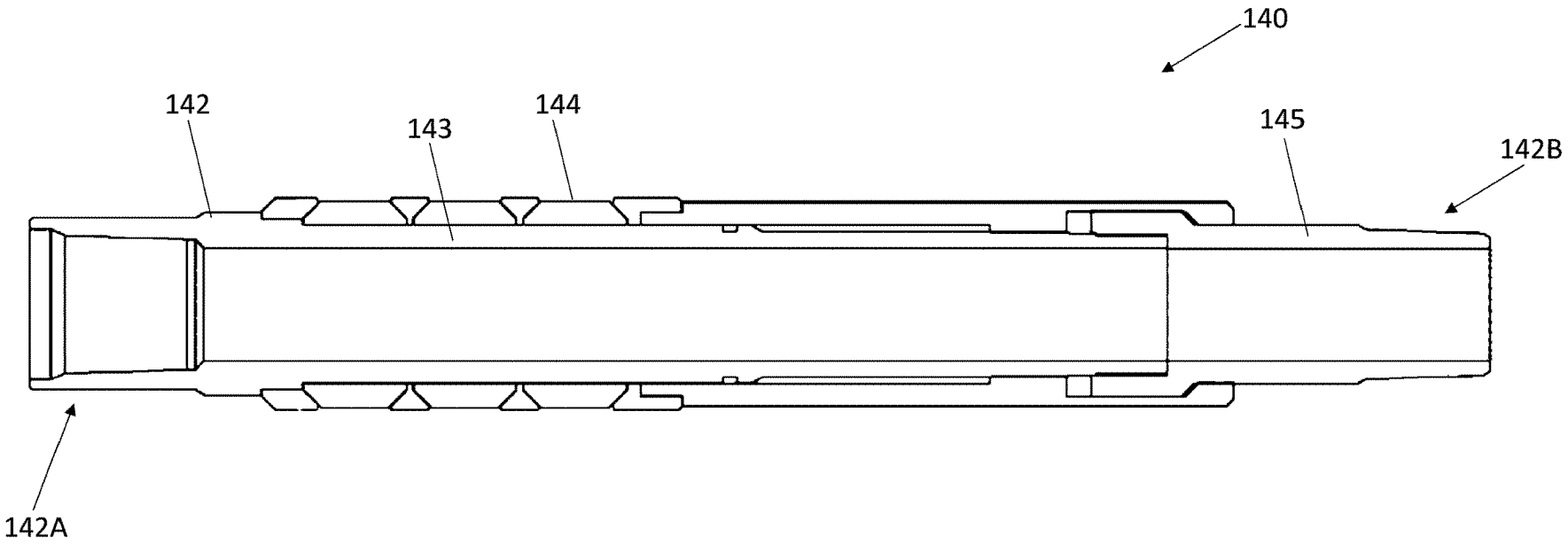
FIG. 9 is a transverse cut view of the isolation segment shown in FIG. 8, showing a fluid passage extending through the segment, according to an embodiment.

With reference to FIGS. 8 and 9, in addition to FIG. 2A, the tubing segments 102 can include an isolation segment 140 adapted to substantially seal the annular space 245 defined between the tubing segments 102 and the reservoir 12 (as seen in FIG. 2A). In this implementation, the isolation segment 140 includes a longitudinal conduit 142 having a first end 142A and a second end 142B. In addition, the isolation segment 140 includes an annular sealing element 144 provided about the longitudinal conduit 142 and extending outwardly therefrom. The longitudinal conduit 142 can take the form of a single conduit extending along an entire length of the isolation segment 140, or two or more conduit sections connected to one another. In this implementation, the longitudinal conduit 142 includes a first conduit 143 and a second conduit 145 connected to one another. As illustrated in FIG. 9, the annular sealing element 144 is connected to and extends from each of the first and second conduits 143, 145. The two conduits 143, 145 can be connected by a threaded connection, a press-fit connection, a keyed joint connection or any other suitable connection method or combination thereof.

As will be described further below, the annular sealing element 144 is adapted to extend within the annular space 245 and seal a section thereof for defining two separate zones, or intervals, on either side thereof. In some implementations, the annular sealing element 144 is installed about the longitudinal tubing 142 and extends outwardly therefrom to engage the inner surface of the casing string 250. It should be understood that, in implementations where the wellbore does not include the casing string 250, the annular sealing element 144 can be adapted to engage the reservoir 12, i.e., the inner surface of the wellbore. In this implementation, and as illustrated in FIG. 2A, the isolation segment 140 can be installed between an adjacent pair of production and injection segments 104, 106, thereby isolating them from each other. It should be understood that a pair of annular sealing elements 144 can be adapted to define a corresponding operational zone of the well completion system 100 therebetween for injection-only or production-only operation. For example, a pair of annular sealing elements 144 installed on either side of an injection segment 104 effectively defines an injection zone 20 of the well completion system therebetween. Similarly, a pair of annular sealing elements 144 installed on either side of a production segment 106 effectively defines a production zone 30 therebetween.

Referring to FIG. 2A, it should be understood that the injection zones 20 refer to sections of the well completion system 100 at which injection fluid is injected into the reservoir. Similarly, the production zones 30 refer to the sections of the completion well system 100 along which production fluid is recovered from the reservoir. It is appreciated that more than one sealing element 144 can be installed between adjacent production and/or injection segments, thereby defining "blank" zones in which no injection or production operations are being performed. It is also appreciated that more than one injection or production segment could be installed for a given injection or production zone, respectively.

Figure 10:
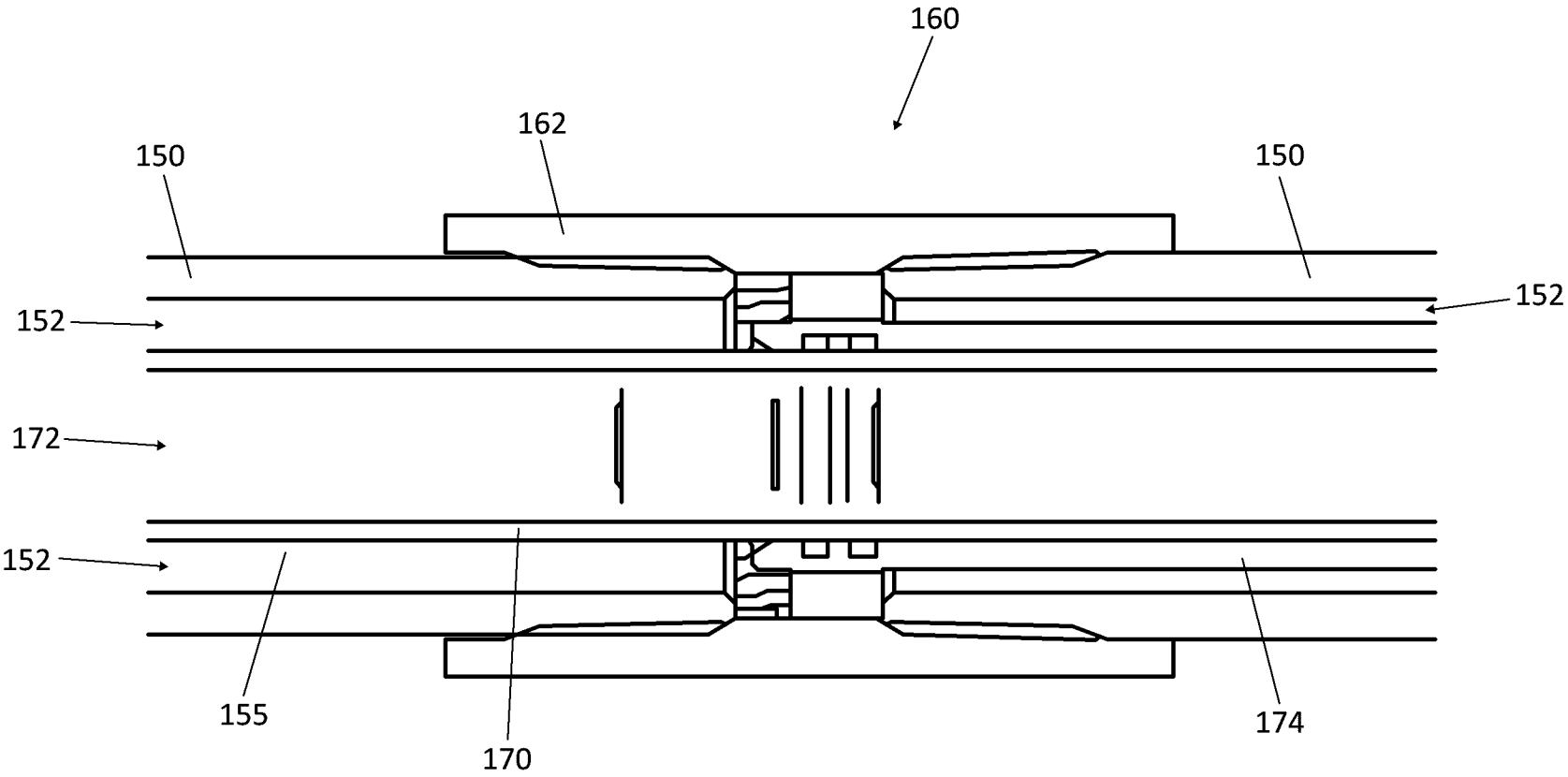
FIG. 10 is a transverse cut view of a connection segment connecting a pair of injection conduits to one another, according to an embodiment.
Figure 11:
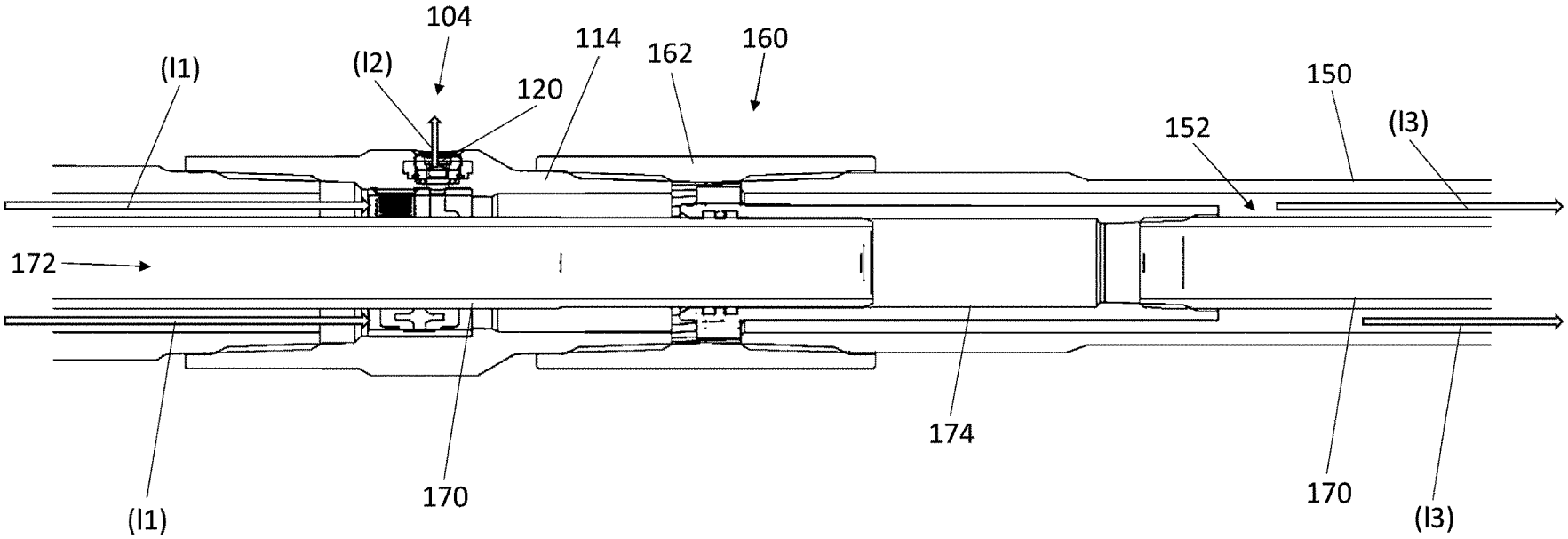
FIG. 11 is a transverse cut view of a portion of the well completion system, showing a flowpath for injection fluid to flow into the reservoir, according to an embodiment.
Figure 12:
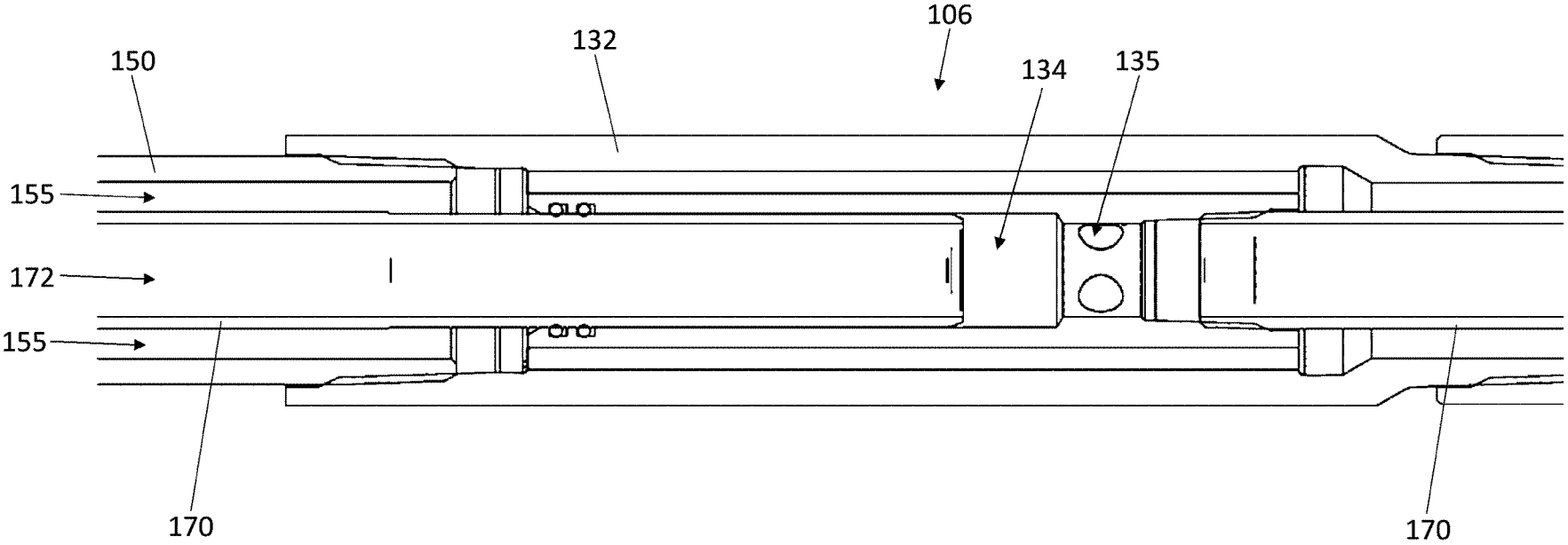
FIG. 12 is a transverse cut view of the production segment shown in FIGS. 6 and 7, showing injection and production conduits connected thereto according to an embodiment.

Referring to FIGS. 10 to 12, the tubing string of the system 100 can include injection conduits 150 adapted to allow injection fluid to flow along the wellbore in order to reach an injection segment 104 for injecting fluid into the reservoir. It is noted that the injection conduits 150 can be connected to other tubing segments 102 to enable the flow of injection fluid between the segments. Each injection conduit 150 includes an conduit passage 152 extending therethrough and being in fluid communication with the injection ports 120 of each injection segment 104. As seen in FIG. 11, injection fluid can flow downhole along the conduit passage 152 (e.g., following the direction of arrow (II)), with a portion of fluid being injected into the reservoir via the injection port 120 (e.g., following the direction of arrow (12)), and another portion flowing further downhole, for example, towards subsequent injection segment(s) 104 (e.g., following the direction of arrow (13)).

In some implementations, the injection conduits 150 can be coupled directly to an adjacent segment for establishing fluid communication therebetween. For example, and with reference to FIG. 12, the injection conduit 150 can be connected to the tubular housing 132 of the production segment 106.

However, in some implementations as shown in FIG. 11, the tubing segments 102 of the tubing string can include a connection segment 160 configured to connect a pair of adjacent tubing segments to one another. In other words, the connection segment 160 can act as a tubing joint for connecting two adjacent components of the tubing string together. For example, and with reference to FIG. 11, an injection conduit 150 can be coupled to an injection segment 104 via a connection segment 160. Alternatively, and as seen in FIG. 10, two adjacent injection conduits 150 can also be coupled to one another using a corresponding connection segment 160. Each connection segment 160 can be shaped and configured to contribute to the stabilization of the tubing segments 102 installed along the wellbore.

Figure 13:
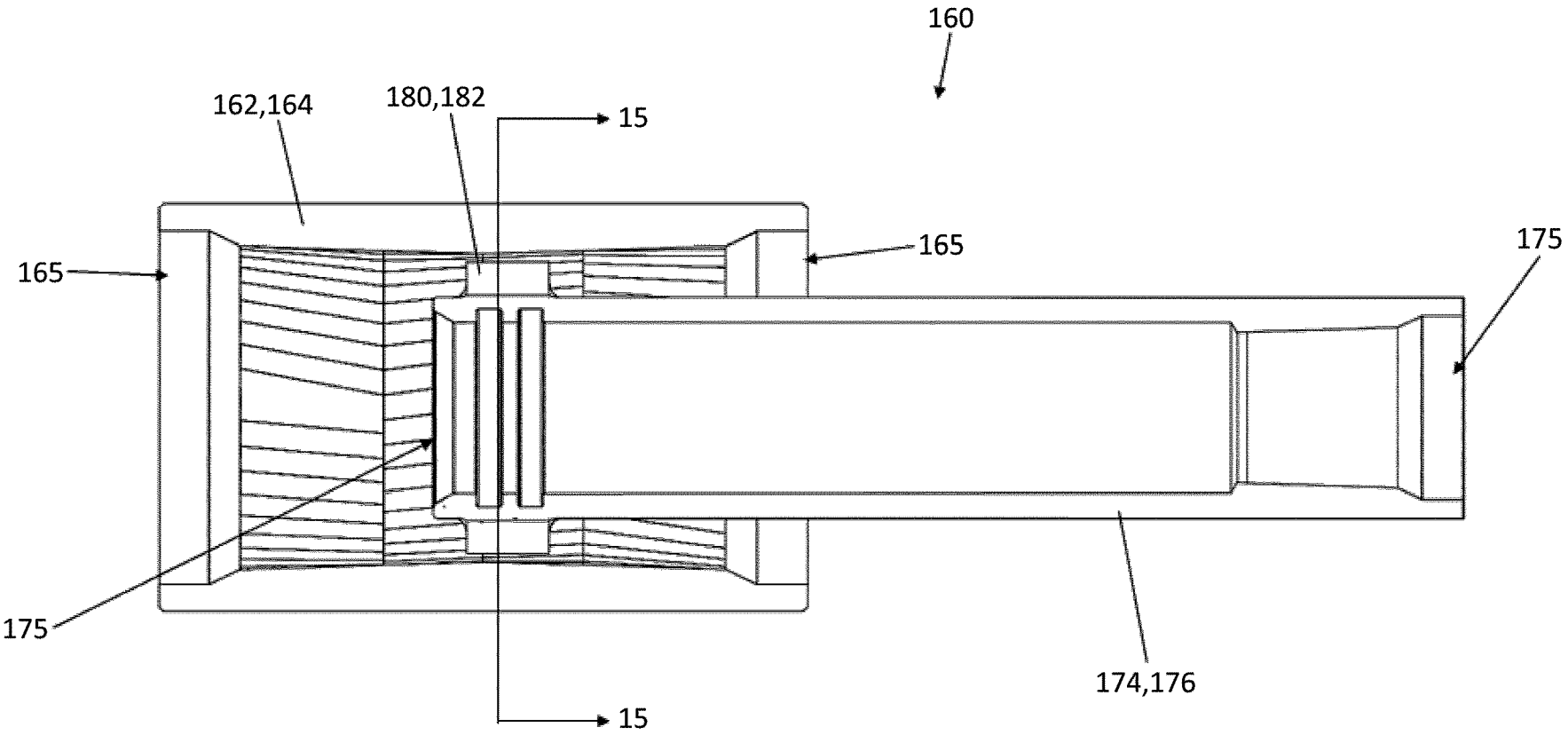
FIG. 13 is a transverse cut view of the connection segment, showing a production coupling engaged within an injection coupling, according to an embodiment.
Figure 14:
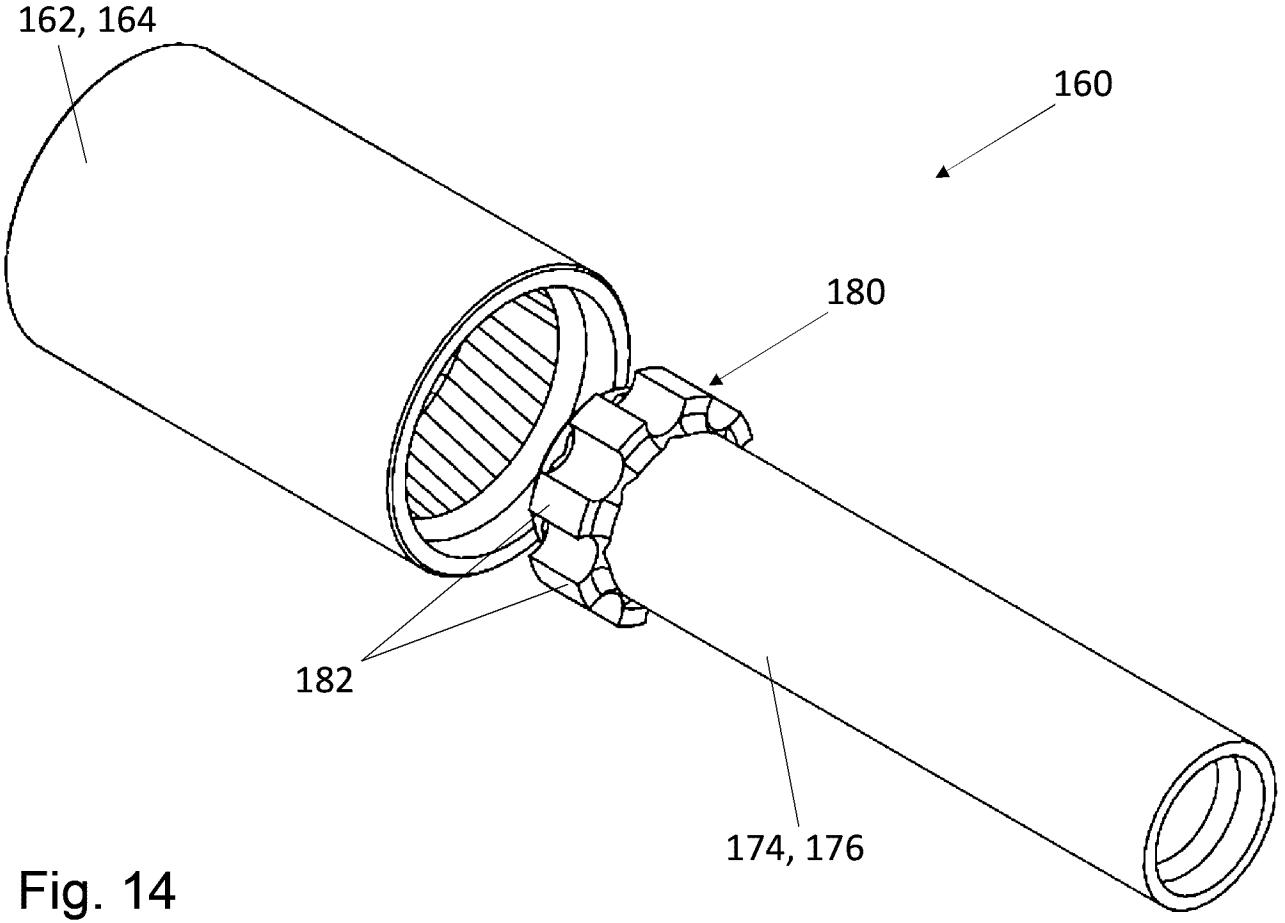
FIG. 14 is an exploded view of the connection segment shown in FIG. 13, showing a conduit stabilizer provided about the production coupling, according to an embodiment.

Now referring to FIGS. 13 and 14, in addition to FIGS. 10 to 12, in this implementation, the connection segment 160 includes an injection coupling 162 adapted to connect a pair of adjacent conduits or segments together. The injection coupling 162 has a tubular housing 164 defining a fluid passage therethrough and two connection sites 165, i.e., one connection site 165 at each end of the tubular housing 164. It should thus be understood that a pair of tubing segments 102 or conduits can be connected to the injection coupling 162 by connecting corresponding ends of the segments or conduits to respective connection sites 165. In some implementations, the conduits connected to the injection coupling 162 can be the same on either side, such as a pair of injection conduits 150 (seen in FIG. 10), or two different conduits on either side, such as an injection conduit on a first side and the valve housing 114 on a second side (seen in FIG. 11). It is also appreciated that any other suitable type of conduits can be connected to the connection sites 165 of the injection coupling 162.

It is noted that the injection coupling 162 enables fluid flow from a first conduit connected to a first one of the connection sites 165 to a second conduit connected to a second one of the connection sites 165. In some implementations, conduits can be connected to the connection site 165 via a threaded connection, a press-fit connection, a keyed joint connection or any other suitable connection method or combination thereof. As seen in FIG. 10, the conduits 150 (or segments) connected to the injection coupling 162 can be engaged therein so as to have a portion thereof (e.g., an end portion) be positioned proximate a central portion of the injection coupling 162. In this implementation, the central portion of the injection coupling 162 can include an abutment surface extending inwardly within the housing 164 and adapted to have the conduits 150 abut thereon when engaged with the injection coupling 162. In some implementation, the injection coupling 162 can be generally symmetrical such that the conduits 150 connected thereto extend within the tubular housing 164, via the connection sites 165, by about the same distance on either side thereof.

Still referring to FIGS. 10 to 12, the tubing segments 102 can include production conduits 170 adapted to allow production fluid to flow along the wellbore between the various tubing segments 102 to be recovered at surface. Each production conduit 170 includes a production fluid passage 172 extending therethrough and being in fluid communication with the production fluid passage 134, and therefore, with the production ports 135 of each production segment 106. The production conduits 170 are thus configured to transport production fluid produced from the reservoir via the corresponding production fluid passage 172. As seen in FIG. 12, production conduits 170 can be connected via either end of the production fluid passage 134 of the production segment 106 and can be generally aligned and coaxial with the production fluid passage 134. It is noted that the production conduits 170 can be connected via any suitable connection method, such as via a threaded connection, a press-fit connection, a keyed joint connection or any other suitable connection method or a combination thereof. In this implementation, a plurality of production conduits 170 can be connected together in an end-to-end manner and are connected to, or extend through, or partly through, various tubing segments 102 for transporting production fluid therebetween and towards surface.

Referring to FIGS. 10, 11, 13 and 14, the connection segment 160 can further include a production coupling 174 for connecting production conduits 170 to one another. The production coupling 174 can have a tubular housing 176 defining a fluid passage therethrough and two connection sites 175, i.e., one connection site 175 at each end of the tubular housing 176. It should thus be understood that a pair of tubing segments 102, such as production segments 106 or production conduits 170, can be connected to the production coupling 174 by connecting corresponding ends of the conduits to respective connection sites 175. The production coupling 174 enables fluid flow from a first conduit connected to a first one of the connection sites 175 to a second conduit connected to a second one of the connection sites 175. In some implementations, conduits (e.g., production conduits 170, the tubular housing of the production segment 106, etc.) can be connected to the connection site 175 via a threaded connection, a press-fit connection, a keyed joint connection or any other suitable connection method or combination thereof. It is appreciated that various configurations of the production coupling are possible for connecting two adjacent conduits together.

As seen in the illustrated implementations, the well completion system 100 can be configured in a manner to have the production conduits 170 extend within the injection conduits 150 along the wellbore. Therefore, it should be understood that the injection fluid can flow along the well completion system 100 via an annulus 155 (seen in FIGS. 12 and 15) defined between the injection and production conduits 150, 170. It is noted that the well completion system 100 can include a plurality of lengths of conduits, which include a production conduit extending within a corresponding injection conduit. In some implementations, the production conduits 170 can be concentrically positioned within the corresponding injection conduits 150, although other configurations are possible. As such, in this implementation, the annulus 155 can have a generally even cross-sectional area around the production conduit 170 installed within the injection conduit 150.

Although the implementations of the well completion system 100 described and illustrated herein include production conduits installed within injection conduits, it is appreciated that the opposite is possible and may be used. More specifically, in some implementations, the injection conduits can be installed within corresponding production conduits such that production fluid flows along the annulus 155 defined therebetween, and injection fluid flows along a central passage within the injection conduits.

In some implementations, the production coupling 174 can be positioned within the injection coupling 162 to effectively hold the production conduits within the injection conduits. In other words, the production coupling housing 176 is adapted to engage the injection coupling housing 164. As such, it is appreciated that the annulus defined between the production coupling housing 176 and the injection coupling housing 164 is part of the annulus 155 of the completion system 100 (i.e., the annulus between the injection and production conduits). In this implementation, the production coupling 174 includes one or more conduit stabilizers 180 adapted to support the production coupling within the injection coupling, and stabilize the production conduits 170 along the wellbore and within the corresponding injection conduits 150. In other words, the production couplings 174 are configured, via respective conduit stabilizers 180, to set the position of the production conduits 170 connected thereto within the surrounding injection conduit 150. Therefore, in this implementation, the conduit stabilizers 180 are configured to support the production conduit 170 concentrically within the corresponding injection conduit 150. The conduit stabilizers 180 can be coupled to the production coupling 174 or made as part of a one-piece unit with the production coupling housing 176.

Figure 15:
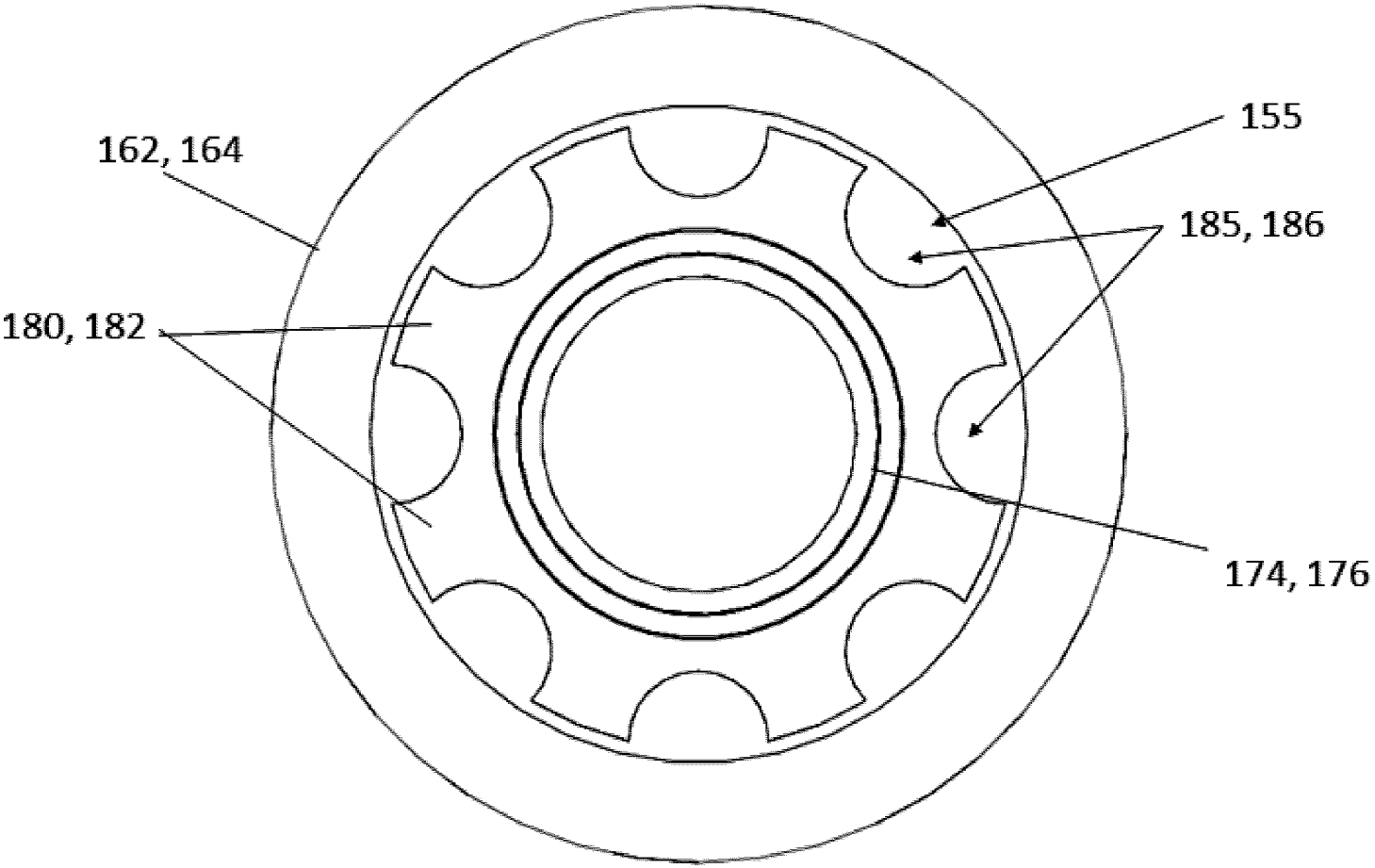
FIG. 15 is a cross-sectional view of the production segment taken along line 15-15 shown in FIG. 13, showing fluid passageways defined between each pair of protrusions extending from the production coupling, according to an embodiment.

As seen in FIGS. 13 to 15, in one implementation, the conduit stabilizers 180 include protrusions 182 extending outwardly from the production coupling 174. Referring more specifically to FIG. 15, the protrusions 182 can be spaced from one another around the production coupling housing 176 and define openings 185 therebetween. The protrusions 182 can be positioned at regular intervals about the production coupling housing 176, although it is appreciated that other configurations are possible. The protrusions 182 can have any suitable shape and size, thereby defining openings 185 of corresponding shape and size between each pair of protrusions. For example, in this implementation, the protrusions 182 have curved sidewalls, thereby defining openings 185 having a semi-circular cross-section. However, it is appreciated that the conduit stabilizers 180 can have any suitable number, shape and/or size configured to engage the injection coupling housing in any suitable manner.

The stabilizer 180 can take the form of a radial support ring that is mounted about the production coupling housing 176 and secured thereto, however, in the present implementation, the stabilizer 180 and production coupling housing 176 form a single component. The radial support ring can be made of the same or different material compared to the coupling housing 176. Additionally, in some implementations, the injection coupling has a threaded inner surface and the outer ends of the stabilizer 180 is cooperatively threaded so as to position and secure the stabilizer (and thus the production coupling) within the injection coupling housing 164. Alternatively, the stabilizer 180 can be housed within a space defined between the ends of respective conduits or segments mounted in either end of the connection segment 160 (e.g., at each connection site 165). As seen in FIG. 15, the protrusions 182 can be spaced from the inner surface of the injection coupling so as to define some play therebetween, i.e., a volume of space allowing the injection coupling to move radially within the injection coupling. The play can be useful to facilitate insertion of the production coupling within the injection coupling (e.g., by mitigating the risk of the conduits shouldering against one another), along with reducing wear and tear due to friction.

In this implementation, the protrusions 182 are adapted to extend into the annulus 155 and engage an inner surface of the surrounding injection coupling housing 164 for positioning and supporting the production coupling 174 therein. In this implementation, the protrusions 182 extend radially from the production coupling housing 176, although other configurations are possible, such as extending therefrom at an angle, for example. It is noted that when the production coupling 174 is installed within the injection coupling 162, the protrusions 182 engage the inner surface of the injection coupling housing 164 such that the openings 185 define fluid passageways 186 to allow injection fluid to flow therethrough. As described above, injection fluid is adapted to flow through the annulus 155, through the openings 185 defined in the production coupling 174, and then into the downstream annulus. As such, it is appreciated that, in this implementation, the fluid passageways 186 are injection fluid passageways.

Referring broadly to FIGS. 1 to 15, in some implementations, while using the well completion system 100, injection fluid can be injected from the surface such that it flows down the wellbore along the annulus 155 within the injection conduits 150, through the injection ports 120 of respective injection segments 104 and into the annular space 245 defined between adjacent sealing elements 144 in an injection zone 20, and ultimately into the reservoir 12. Production fluid can be produced from the reservoir 12 via a pumping system (not shown), for example, or other mechanisms such as gas lift. More specifically, in production zones 30, the production fluid can flow into the outer annulus 245 from the reservoir 12 and is then recovered by flowing through the production ports 135 of corresponding production segments 106 and then flowing into the production fluid passage 134 and up toward the surface along the production conduits 170. It is appreciated that the annular sealing elements 144 prevent fluid communication between two adjacent zones (e.g., injection zone 20 and/or production zone 30) within the outer annulus 245. Therefore, injection and production fluids can flow into and from the reservoir 12 simultaneously enabling synchronous injection and production within the well. When the reservoir has been fractured, the process using synchronous injection and production can be referred to as a synchronous frac-to-frac process.

Figure 16:
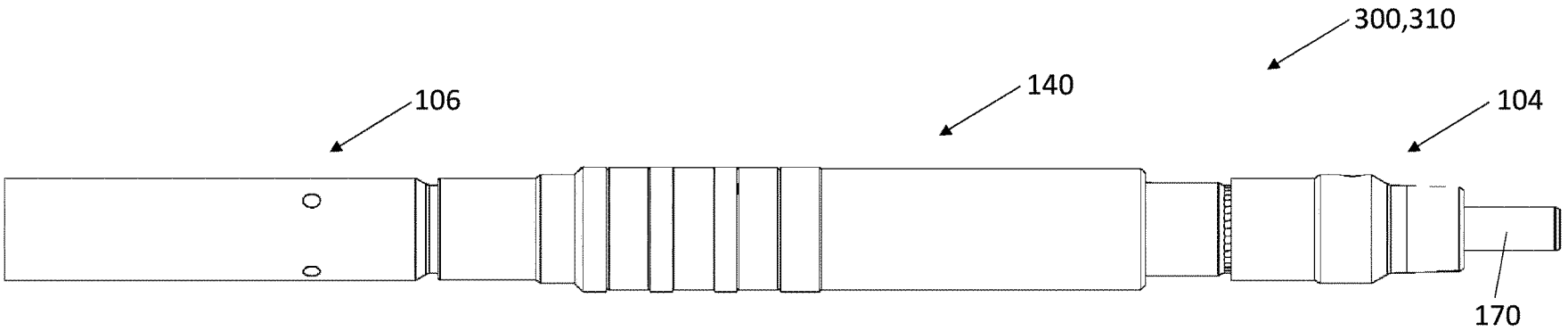
FIG. 16 is a side view of an operational subassembly formed of various tubing segments connected together according to an embodiment.
Figure 17:
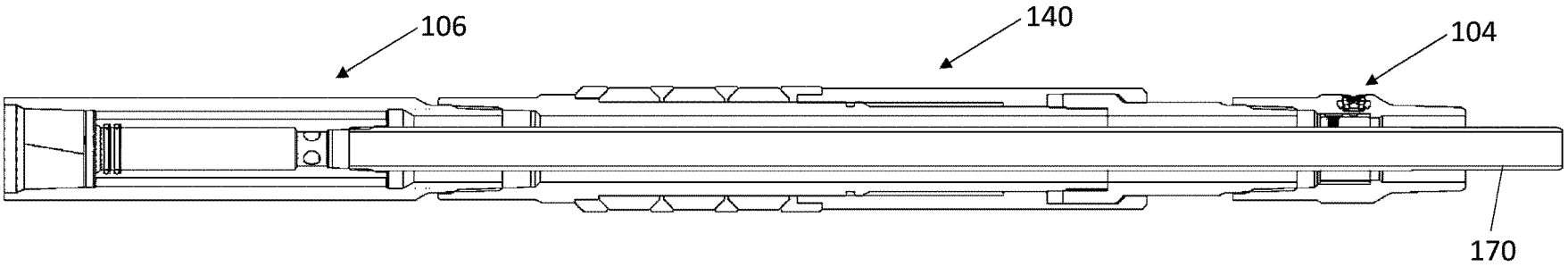
FIG. 17 is a transverse cut view of the tubing subassembly shown in FIG. 16.

Now referring to FIGS. 16 to 20, some tubing segments can be pre-assembled at surface to form subassemblies 300 adapted to facilitate installation of the well completion system 10. In some implementations, various subassemblies 300 can be connected to one another in an end-to-end manner as the subassemblies are run downhole for installation along the horizontal section of the wellbore. In FIGS. 16 and 17, an example operational subassembly 310 is illustrated and includes an injection segment 104 and a production segment 106 connected to one another via an isolation segment 140. As illustrated, the downhole end of the isolation segment 140 engages the uphole end of the injection segment 104, and the downhole end of the production segment 106 engages the uphole end of the isolation segment 140. It should be noted that the downhole ends of the injection, production and isolation segments have an outer diameter which is smaller than an outer diameter of the corresponding uphole ends. Therefore, the tubing segments 102 can be "plugged" or "stabbed" into one another to form the subassemblies 300.

In some implementations, the well completion system 100 can include a plurality of operational subassemblies 310 fluidly connected together via conduits (e.g., injection and production conduits) along the wellbore. In some implementations, a single length of conduits can connect two operational subassemblies 310 together, although it is appreciated that two or more lengths of conduits can be connected together, via the connection segment 160, and positioned between a pair of operational subassemblies 310. It should be understood that having additional conduits installed between subassemblies effectively increases the distance between two adjacent zones (i.e., between injection and/or production zones 20, 30).

Figure 18:
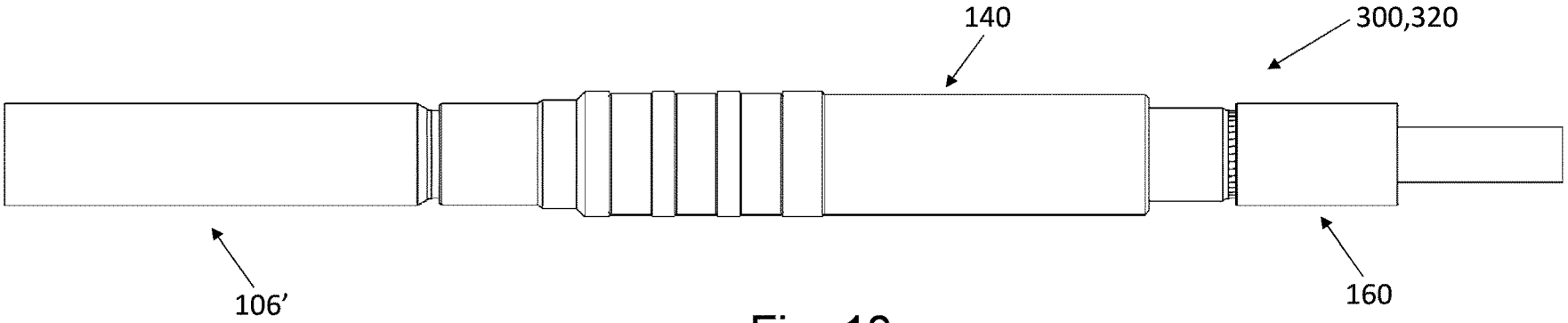
FIG. 18 is a side view of a flow-by subassembly formed of various tubing segments connected together according to an embodiment.
Figure 19:
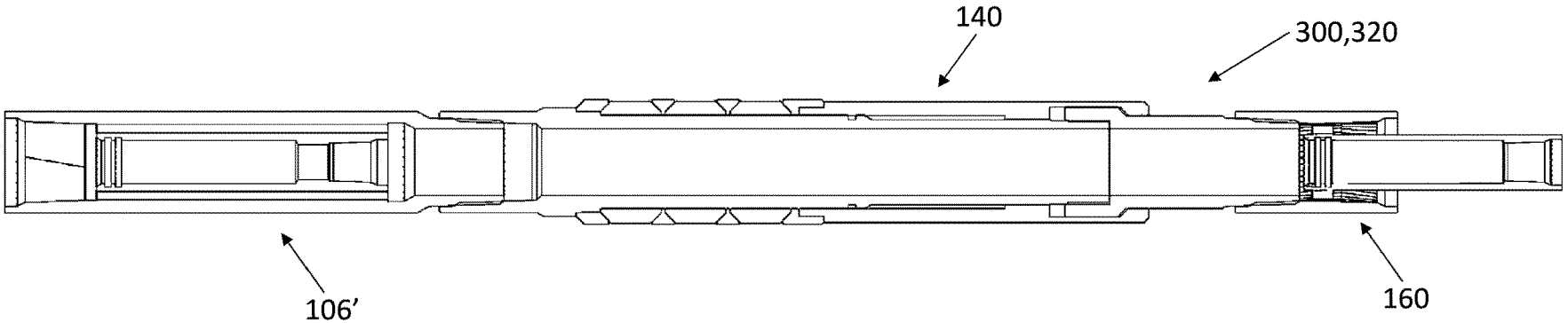
FIG. 19 is a transverse cut view of the tubing subassembly shown in FIG. 18.

In some implementations, the well completion system 100 can further include a flow-by subassembly 320, as illustrated in FIGS. 18 and 19, configured to position an annular sealing element 144 and increase stability of the conduits along the wellbore. In this implementation, the flow-by subassembly 320 includes an isolation segment 140 having a connection segment 160 connected thereto at a downhole end, and an un-ported segment 106' connected thereto at an uphole end. It should be understood that, as used herein, the un-ported segment 106' refers to a segment (e.g., a length of conduit) which does not include ports communicating with the reservoir. In this implementation, the un-ported segment 106' includes the same structural features as the production segment 106, although the un-ported segment 106' does not include production ports 135. As such, the flow-by subassembly 320 is configured to allow fluid flow therethrough, prevent fluid communication between the tubing string and the reservoir and position an annular sealing element 144 at a desired location.

It should be noted that positioning operational and flow-by subassemblies 310, 320 in an alternating arrangement along the wellbore would define injection and production zones in corresponding alternance. Therefore, it is appreciated that the concentric conduits enabling simultaneous flow of injection and production fluid along the wellbore, and the well completion defining alternating injection and production zones, the well completion system 100 can be operated to perform synchronous frac-to-frac processes. The subassemblies 300 can be connected to one another directly, although it is appreciated that one or more conduits (injection and production conduits) can be installed between adjacent pairs of subassemblies. Therefore, various configurations of tubing segments can be installed along corresponding lengths of the wellbore. For example, in one implementation, injection and production segments can be installed in alternance along the entire length of the wellbore. However, it should be noted that two or more injection or production segments can be installed consecutively, or that lengths of un-ported conduits can be installed between two other segments for defining a "blank" region of the reservoir in which fluid is not injected, and from which fluid is not produced.

Figure 20:
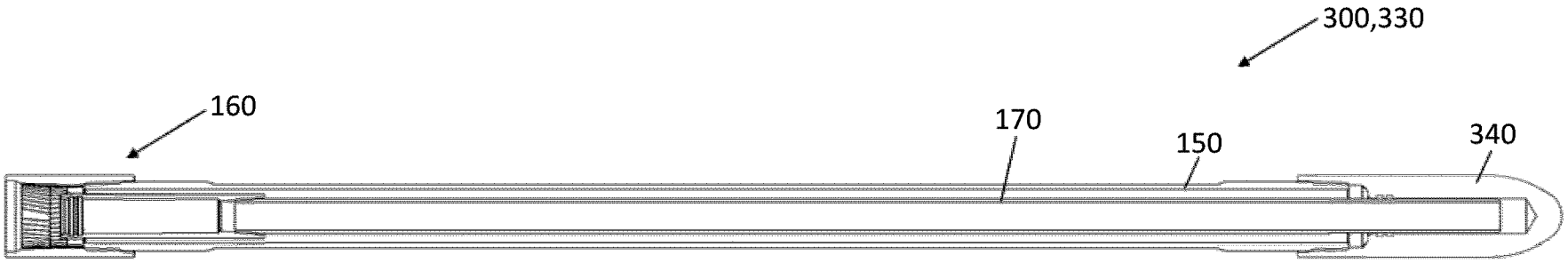
FIG. 20 is a side view of a downhole end subassembly according to an embodiment, configured to be installed at the toe of the wellbore.

As seen in FIG. 20, the well completion system can include a downhole end subassembly 330 adapted to be positioned at a downhole end of the wellbore, e.g., proximate the toe. The downhole end subassembly 330 can include a conduit cap 340 at a downhole end thereof adapted to receive an injection conduit 150, and a production conduit 170 concentrically provided within the injection conduit. The downhole end subassembly 330 can further include a connection segment 160 at an uphole end thereof to facilitate connection of additional conduits and/or other subassemblies thereto. The conduit cap 340 is adapted to prevent fluid flow in a downhole direction and provide additional stability to the conduits connected thereto. It should also be noted that various other suitable subassemblies 300 (i.e., combination of conduits and/or tubing segments) can be formed and preassembled at surface prior to being installed in the wellbore.

In an exemplary implementation, the well completion is initiated by first running the downhole subassembly 330 down the wellbore. Then, a first operational subassembly 310 can be run in and connected to the downhole subassembly 330, either directly or via a length of conduits (i.e., injection and production conduits). Following the first operational subassembly 310, a flow-by subassembly 320 can be run downhole for connection with the first operational subassembly 310. Once again, the subassemblies can be connected together directly, or spaced apart from one another via any suitable number of conduits extending therebetween. As described above, the operational and flow-by subassemblies can be alternatively installed downhole, with or without conduits extending therebetween until the well completion reaches the heel of the wellbore (or any other desired point) and a final isolation segment is installed. It is appreciated that the injection and production conduits can extend uphole past the final isolation segment towards the surface to facilitate production of fluids from the reservoir and injection of fluid into the injection conduits from surface. It is further appreciated that the injection valves are run downhole in the closed configuration (i.e., with the breakable barrier being intact).

It will be understood that implementations of the well completion system described herein can be used in relation with various operations or completion methods, such as multistage fracturing operations, for example. The fracturing operation can include various steps, some of which are described below. In fracturing operations, the wellbore can first be drilled and lined with the casing. In plug-and-perf fracturing operations, a perforating gun is lowered down the casing and fired to form perforations through the casing and into the formation at the lowest stage of the well. Then fracturing fluid is pumped down to fracture the reservoir as the fracturing fluid is forced under pressure into the perforations. A plug can then be placed above (i.e., uphole) the fractured perforations, and the process can be repeated one stage uphole, and so on, up the wellbore to form multiple fractured stages.

In some implementations, each stage of the wellbore can be provided with one or more tubing segments, such as the above-described injection segments, production segments, isolation segments, connection segments, or any other suitable segments or combinations thereof. The number of tubing segments per stage can depend on the length of the stage and the configuration of the segments, and each tubing segment of the same type (e.g., each injection segment) can be the same along each stage, or have different configurations. As described above, a first injection segment can have a valve provided with a fluid channel having a first configuration, and subsequent valves can be provided with respective fluid channels having a different second configuration. However, it is appreciated that each injection segment can be generally identical along the entire wellbore. It should be understood that the same is applicable for each tubing segment types (e.g., injection, production, isolation and connection segments).

The tubing segments can be installed and secured in place prior to operating the well for the recovery of fluids from the reservoir. The well completion system can therefore be configured to allow injection and production at the same time along the wellbore, where the surrounding reservoir has been fractured as part of a multistage fracturing operation. In other words, the well completion system can facilitate synchronous frac-to-frac operations, although other operational configurations and processes are possible. For example, the well completion system can be used for asynchronous frac-to-frac operations where injection and production occur in an alternating fashion. The well completion system can also be used in other applications, such as geothermal applications. It is also noted that the well completion system can be used in applications where the formation is not required to be fractured but has a permeability that enables fluid injection or includes naturally formed fractured.

It is also noted that the injection valve assembly that includes a fluid pressure breakable barrier and a flow restriction component can be used in various fluid injection operations within a wellbore. The injection valve assemblies can facilitate fluid injection into the formation, and fluids can then be recovered via the same well and/or via other wells located within the formation. The injection valve assemblies can be used in conjunction with various segments and the completion systems described herein, or can be integrated in alternative completion assemblies within a wellbore.

The present disclosure may be embodied in other specific forms without departing from the subject matter of the claims. The described example implementations are to be considered in all respects as being only illustrative and not restrictive. For example, in the implementations described herein, the packers installed along the wellbore are typically hydraulically set and are configured to set at a pressure below the threshold pressure of the burst discs. However, it is noted that other types of packers can be used, such as swellable packers configured to be set via absorption of fluids, and are therefore not dependent on fluid pressure. Using swellable packers can enable installation of the valve assemblies downhole in the open configuration (e.g., without the breakable barrier) since fluids being pumped downhole would be initially absorbed by the swellable packers.

The well completion system described herein can also be used for various downhole operations. In some implementations, the completion system is used as part of hydrocarbons recovery operations, where injection fluids are injected to enable the production of fluids including hydrocarbons. It should however be noted that the completion method can be used as part of other operations, such as gas flooding operations (e.g., using Methane or CO2), waterflooding operations, geothermal operations and solution mining operations, for example.

The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the completion well system as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the implementation and use of the completion well system, and corresponding parts, as briefly explained and as can be easily inferred herefrom, without departing from the scope of the disclosure.

The invention claimed is:

1. A well completion system for producing fluids from a reservoir via a wellbore provided in the reservoir, comprising:

a tubing string extending along the wellbore and comprising:

an injection segment comprising:

an injection valve including an injection valve housing defining an injection fluid passage allowing injection fluid to flow through the housing, and an injection port for establishing fluid communication with the surrounding reservoir to enable injection of injection fluid within the reservoir, the injection valve comprising:

a flow restriction component configured to restrict fluid flow between the injection fluid passage and the injection port; and a breakable barrier installed within the injection port, the breakable barrier being fluid-activated to operate the injection valve between a closed configuration where the breakable barrier occludes the injection port for preventing fluid flow into the reservoir, and an open configuration where the breakable barrier is at least partially removed from within the injection port for allowing fluid flow into the reservoir;

a production segment comprising:

a tubular housing defining a production fluid passage therethrough allowing production fluid to flow through the housing, and having a production port for establishing fluid communication between the production fluid passage and the surrounding reservoir to enable flow of production fluid from the reservoir into the production fluid passage, the tubular housing further including injection fluid passageways allowing injection fluid to flow through the production segment;

one or more injection conduits coupled to the injection and production segments, and being adapted to allow injection fluid to flow along the wellbore through at least one injection or production segment, each injection conduit being in fluid communication with the injection fluid passage;

one or more production conduits coupled to the injection and production segments, and being adapted to allow production fluid to flow along the wellbore through at least one injection or production segment, each production conduit being in fluid communication with the production fluid passage; and a connection segment comprising:

an injection coupling adapted to connect the injection conduit to one of another injection conduit and the injection valve housing; and a production coupling engaged with the injection coupling and configured to connect the production conduit to one of another production conduit and the tubular housing of the production segment, the production coupling comprising a conduit stabilizer configured to position the production coupling relative to the injection coupling in order to position the production conduit relative to the injection conduit.

2. The well completion system of claim 1, wherein the one or more production conduits extend within the one or more injection conduits to define an annulus therebetween, and wherein the injection fluid flows along the wellbore in the annulus.

3. The well completion system of claim 2, wherein the one or more production conduits are concentric relative to the one or more injection conduits.

4. The well completion system according to claim 2, wherein the injection coupling comprises an injection coupling tubular housing defining a fluid passage to allow a flow of injection fluid therethrough, and a connection site at each end of the injection coupling tubular housing for connection with the one or more injection conduits, the injection valve housing or a combination thereof.

5. The well completion system according to claim 4, wherein the production coupling comprises a production coupling tubular housing defining a fluid passage to allow a flow of production fluid therethrough, and a connection site at each end of the production coupling tubular housing for connection with the one or more production conduits, the production segment or a combination thereof.

6. The well completion system according to claim 5, wherein the production coupling tubular housing is concentrically positioned within the injection coupling tubular housing, and wherein the conduit stabilizer comprises protrusions extending from the production coupling tubular housing towards an inner surface of the injection coupling housing.

7. The well completion system according to claim 6, wherein the protrusions are spaced apart about the production coupling housing and are adapted to engage an inner surface of the injection coupling housing, and wherein the protrusions are adapted to define an opening between each pair of adjacent protrusions to enable injection fluid to flow therethrough.

8. The well completion system according to claim 2, wherein the tubular housing of the production segment comprises a plurality of production ports spaced about and extending radially from the production fluid passage.

9. The well completion system according to claim 8, wherein the injection fluid passageways extend axially through the tubular housing of the production segment between the production ports.

10. The well completion system according to claim 9, wherein the injection fluid passageways are in fluid communication with the annulus, and wherein the annulus is sealed from the production fluid passage.

11. The well completion system according to claim 1, further comprising an isolation segment having a longitudinal conduit adapted to be connected to at least one of the injection valve housing, the production segment housing, one of the one or more injection conduits and one of the one ore more production conduits, the isolation segment further comprising an annular sealing element extending radially and outwardly from the longitudinal conduit, the annular sealing element being operable to be in sealing engagement with an inner surface of the wellbore.

12. The well completion system according to claim 11, wherein the injection segment, the production segment and the isolation segment each include a downhole end shaped and sized to be inserted in and connected to an uphole end of another one of the injection segment, the production segment or the isolation segment positioned downhole thereto along the tubing string.

13. The well completion system according to claim 1, wherein the injection valve is fluid pressure-activated between the closed and open configurations.

14. The well completion system according to claim 1, wherein the injection valve comprises a valve sleeve securely connected to an inner surface of the valve housing, and wherein the restriction component comprises a fluid channel defined between an outer surface of the valve sleeve and the inner surface of the valve housing, the fluid channel being configured to restrict fluid flow between the injection fluid passage and the injection port.

15. The well completion system according to claim 1, wherein two or more of the injection segment, the production segment and the connection segment are adapted to be connected together at surface to form tubing subassemblies, and wherein the tubing subassemblies are adapted to be connected to one another in an end-to-end manner and run downhole.

16. A method for recovering fluids via a well provided in a subterranean reservoir using the well completion system as defined in claim 1, the method comprising:

injecting an injection fluid down the tubing string and through a plurality of the injection segments into the reservoir to displace fluids from a first region of the reservoir to a second region of the reservoir; and producing a production fluid from the second region of the reservoir via a plurality of the production segments.

17. The method of claim 16, wherein the steps of injecting fluid and producing fluid are performed synchronously.

* * * * *